United States Patent [19]

Aono et al.

[11] 4,283,486

[45] Aug. 11, 1981

[54] SILVER HALIDE COLOR PHOTOGRAPHIC LIGHT-SENSITIVE MATERIAL

[75] Inventors: Toshiaki Aono; Takeshi Hirose, both of Minami-ashigara, Japan

[73] Assignee: Fuji Photo Film Co., Ltd., Minami-ashigara, Japan

[21] Appl. No.: 145,090

[22] Filed: Apr. 30, 1980

[30] Foreign Application Priority Data

Oct. 2, 1979 [JP] Japan ..... 54/126971

[51] Int. Cl.[3] ..... G03C 1/76

[52] U.S. Cl. ..... 430/505; 430/372; 430/537; 430/538; 430/556; 430/557; 430/552; 430/554; 430/961

[58] Field of Search ..... 430/495, 538, 537, 961, 430/543, 372, 505, 556, 557, 552, 554

[56] References Cited

U.S. PATENT DOCUMENTS

| | | | |
|---|---|---|---|
| 2,358,056 | 9/1944 | Clark | 430/538 |
| 3,277,041 | 10/1966 | Sieg et al. | 430/538 |
| 3,364,028 | 1/1968 | Konig | 430/538 |
| 3,582,337 | 6/1971 | Griggs et al. | 430/538 |
| 3,582,339 | 6/1971 | Martens et al. | 430/537 |
| 3,669,709 | 6/1972 | Kasugai et al. | 430/954 |
| 3,700,449 | 10/1972 | Lerner | 430/961 |

FOREIGN PATENT DOCUMENTS

| | | | |
|---|---|---|---|
| 1584280 | 11/1969 | France | 430/961 |

OTHER PUBLICATIONS

Research Disclosure, No. 15162, p. 82, Nov. 1976.

*Primary Examiner*—J. Travis Brown

*Attorney, Agent, or Firm*—Sughrue, Mion, Zinn, Macpeak and Seas

[57] ABSTRACT

A silver halide color photographic light-sensitive material comprising a paper support, at least one color image-forming emulsion layer, and an oxygen-impermeable layer having an oxygen permeability of not more than 2.0 ml/m$^2$·hr·atm, said color image-forming layer and oxygen-impermeable layer being provided on the same side of the paper support.

20 Claims, 2 Drawing Figures

SILVER HALIDE COLOR PHOTOGRAPHIC LIGHT-SENSITIVE MATERIAL

BACKGROUND OF THE INVENTION

1. Field of the Invention

This invention relates to silver halide color photographic light-sensitive material, and more particularly to silver halide color photographic light-sensitive material which permits the prevention of discoloration and fading by light of dye image areas and unexposed areas of dye images obtained by development after imagewise exposure.

2. Description of the Prior Art

In general, dye images obtained by the development of silver halide color photographic light-sensitive material comprise azomethine or indoaniline dye formed by the reaction of an oxidation product of an aromatic primary amine developing agent and a color coupler. These dye images have limited stability to light and to heat under humid conditions; when they are exposed to light for extended periods of time or stored under conditions of high temperature and humidity, discoloration and fading of the dye image areas and discoloration of white areas (that is, areas where a dye image is not present) occurs, leading to reductions in image quality.

Such discoloration or fading of the dye image and discoloration of the white areas is a major problem in silver halide color photographic light-sensitive materials.

The discoloration and fading of the dye image and discoloration of the white areas is considered to be caused mainly by ultraviolet or visible rays, and therefore a number of techniques using ultraviolet ray-absorbing agents or anti-fading agents have been developed to prevent the discoloration and fading due to light. In addition, a number of techniques have been proposed in which couplers of low fading are used.

Examples of such methods using magenta couplers are described in U.S. Pat. No. 3,519,429. Use of hydroxycumarones as an antioxidant is described in U.S. Pat. No. 3,432,300. The use of anti-fading agents containing phenolic hydroxy groups is described in U.S. Pat. No. 3,698,909, and the use of alkyl ethers as an antioxidant is described in Japanese Patent Application (OPI) No. 77526/78 (the term "OPI" as used herein refers to a "published unexamined Japanese patent application").

Although these compounds have some effect in preventing the discoloration and fading of dye images, the effect is not always sufficient, and, moreover, many of them exert adverse side effects, such as reduction of hue, fog formation, insufficient dispersion of an antioxidant into oils (organic solvents having a high boiling point) which prevents the formation of stable oil droplets, and cause crystallization of the antioxidant. Thus, compounds exhibiting sufficiently excellent effects have not yet been discovered.

It is known that oxygen is also responsible for the discoloration and fading of the dye image and discoloration of the white areas, and therefore techniques for preventing the discoloration and fading by preventing oxygen from coming in contact with the dye images have been proposed. For example, such techniques are described in *Research Disclosure,* Vol. 15162, page 82 (November 1976), and Japanese Patent Application (OPI) Nos. 11330/74 and 57223/75 wherein an oxygen-shielding layer formed from a substance having a low oxygen permeability is used to cover the dye images.

According to such methods, after the development of the color photographic light-sensitive material, the dye images are covered with the oxygen-shielding layer, for example, by laminating a polyethylene terephthalate film thereon. If the dye images are completely covered with the oxygen-shielding layer and prevented from coming into contact with oxygen, the magenta and yellow color dye images are greatly improved in their discoloration and fading properties. However, the discoloration and fading of the cyan color image formed from cyan couplers which are normally used in silver halide color photographic light-sensitive material (such as those represented by the formula (VI), as will be explained infra) is accelerated.

For silver halide color photographic lightsensitive material including a sheet of paper as a support (referred to hereinafter merely as "a color light-sensitive material"), anilinopyrazolone based couplers are preferably used because of good hue and color-forming efficiency. However, these couplers have the serious drawback that their use results in occurrence of discoloration and fading of the dye image and discoloration of the white areas.

Therefore it has been strongly desired to develop a technique which permits the use of such couplers as are described above without the occurrence of discoloration and fading.

With respect to the development of more recent color light-sensitive materials, rapid processing has increasingly been of great importance, and the conventional so-called three-bath processing (consisting of color development, bleach-fixing, and stabilization) is often being replaced with two-bath processing (consisting of color development and bleach-fixing). This two-bath processing, however, suffers from the disadvantages that the dye images obtained are inferior in stability and are subject to discoloration and fading.

Moreover, in the rapid development processing of color light-sensitive material, benzyl alcohol is sometimes incorporated into the color-forming developer for the purpose of shortening the development time by accelerating the color development. Such a developer, however, readily causes rapid discoloration and fading of the dye images formed.

Therefore it has been strongly desired to develop a color light-sensitive material which, even when subjected to such a rapid development processing, does not result in discoloration and/or fading of dye images.

SUMMARY OF THE INVENTION

An object of this invention is to provide a color light-sensitive material that, when subjected to development processing, produces dye images which are less subject to discoloration and fading.

Another object of this invention is to provide a color light-sensitive material which is improved with respect to the discoloration and fading of dye images, without exhibiting adverse side effects on its photographic properties.

Another object of this invention is to provide a color light-sensitive material in which couplers having good hue and color-forming efficiency are used, and which is less subject to discoloration and fading of dye images after processing.

Another object of this invention is to provide a color light-sensitive material that, when subjected to rapid processing (such as a two-bath process), produces dye images which are less subject to discoloration and fading.

Other objects of this invention will become apparent from the following description.

According to the invention, therefore, a color light-sensitive material is provided comprising a paper support, a color image-forming layer containing a photographic color coupler which forms a dye on coupling with an oxidation product of an aromatic primary amine, and an oxygen-impermeable layer (oxygen-barrier layer) having an oxygen permeability of not more than 2.0 ml/m$^2$·hr·atm (20° C., dry state) on the same side of the support as that on which the color image-forming layer is provided.

The oxygen permeability is measured acccording to the method defined in ASTM D-1434-63.

DETAILED DESCRIPTION OF THE INVENTION

Figure 1:
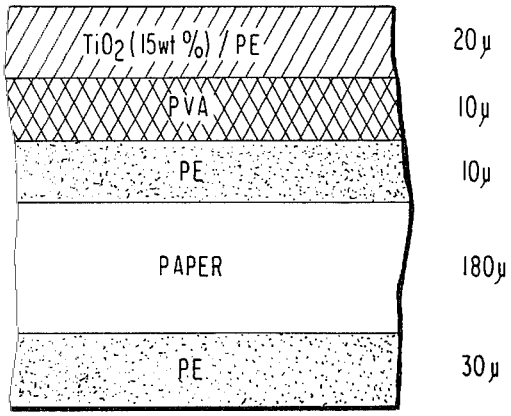
FIG. 1 is a sectional view of an embodiment of a paper support provided with an oxygen-impermeable layer according to the invention.

The expression term "discoloration and fading" as used herein refers to the discoloration and fading of color images and formation of stains in white areas. This invention is particularly useful for the prevention of fading upon exposure to light of magenta and yellow color dye images and the prevention of the formation of stains in white areas upon exposure to light and/or heat.

The layer having an oxygen permeability of not more than 2.0 ml/m$^2$·hr·atm (20° C., dry state) for use in this invention (hereinafter referred to as the "oxygen-impermeable layer" which is synonym to "oxygen-barrier layer") is provided on the support at the same side thereof as that on which the color image-forming layer is to be provided, but they are not always required to be adjacent to each other.

Thus the invention includes, for example:

(1) a color light-sensitive material having a layer made of polyolefin (for example, polyethylene or polypropylene) on one side of the paper support and, in sequence, an oxygen-impermeable layer, a polyolefin layer and a color image-forming layer on the other side of the paper support;

(2) a color light-sensitive material having a polyolefin layer on one side of the paper support and, in sequence, a polyolefin layer, an oxygen-impermeable layer and a color image-forming layer or, if desired, a polyolefin layer, an oxygen-impermeable layer, a polyolefin layer, and a color image-forming layer on the other side of the paper support;

(3) a color light-sensitive material having a polyolefin layer on one side of the paper support and, in sequence, an oxygen-impermeable layer, a polyolefin layer, an oxygen-impermeable layer and a color image-forming layer on the other side of the paper support; and (4) a color light-sensitive material having in sequence an oxygen-impermeable layer and a color imageforming layer on one side of the paper support, and a polyolefin layer on the other side thereof.

In the above embodiments, between the color image-forming layer and the polyolefin layer or oxygenimpermeable layer a hydrophilic organic colloidal layer may be provided, such as a gelatin undercoating layer, an undercoating layer consisting of a polymer, etc. Furthermore, this polymer layer may be subjected to corona discharge, as is described in West German Pat. No. 1,921,641. Multiple color image-forming layers may also be provided, as well as other layers conventionally used therewith, such as an intermediate layer, a surface protective layer, and so forth. The silver halide emulsion and the coupler may exist in the same color image-forming layer or may be present in separate layers.

The reverse side of the paper support, which has no color image-forming layer thereon, may be provided with a layer of a polymer other than polyolefin, or may not be provided with any polymer layer. Any polymer capable of forming a waterproof film can be used for the formation of such a polymer layer. For example, homo- and copolymers of olefin, vinyl chloride, vinylidene chloride, acrylonitrile, acrylate, methacrylate, acrylic acid amide, methacrylic acid amide, vinyl alcohol, styrene, fluorinated vinyl, ethylene terephthalate, and vinyl acetate, cellulose acetate, polyamide, polycarbonate and cellophane can be used. This polymer layer may be a single layer or a laminate comprising two or more layers.

The oxygen permeability of the oxygen-impermeable layer of this invention is not more than 2.0 ml/m$^2$·hr·atm (20° C., dry state), and is preferably not more than 1.0 ml/m$^2$·hr·atm (20° C., dry state).

The thickness of the oxygen-impermeable layer of this invention is not critical, provided that the oxygen permeability is not more than 2.0 ml/m$^2$·hr·atm (20° C., dry state). Preferably it is from about 1 to 100 μm, and more preferably from 2 to 50 μm. When the thickness is less than 1 μm, pin-holes are easily formed in the oxygen-impermeable layer, and oxygen may thus be permeated. However, the polymer constituting the oxygen-impermeable layer sometimes partly permeates into the paper support, in which case the desired oxygen permeability can be obtained even if the oxygen-impermeable layer is less than 1 μm. On the other hand, when it is more than 100 μm, the total thickness of the color light-sensitive layer is increased to an undesirable extent.

If desired, the oxygen-impermeable layer of this invention can contain, in addition to the polymer used as the binder, a filler, such as titanium oxide and/or barium sulfate, a fluorescent brightener, an antistatic agent, or an ultraviolet ray-absorbing agent, and combinations thereof. The amount of filler such as titanium oxide and barium sulfate being added is preferably not more than 50% by weight, based upon the weight of the binder, and preferably is from 5 to 30% by weight.

Polymers which can be used as the binder constituting the oxygen-impermeable layer of this invention include homo- and copolymers of acrylonitrile, alkyl acrylates such as methyl acrylate, ethyl acrylate and butyl acrylate, alkyl methacrylates such as methyl methacrylate and ethyl methacrylate, methacrylonitrile, alkyl vinyl esters such as vinyl acetate, vinyl propionate, vinyl ethyl butyrate and vinyl phenyl acetate, alkyl vinyl ethers such as methyl vinyl ether, butyl vinyl ether and chloroethyl vinyl ether, vinyl alcohol, vinyl chloride, vinylidene chloride, vinyl fluoride, styrene and vinyl acetate (in the case of copolymers, ethylene and/or propylene can be used as comonomers), cellulose acetates such as diacetyl cellulose and triacetyl cellulose, polyesters such as polyethylene terephthalate, a fluorine resin, polyamide (nylon), polycarbonate, polysaccharide, blue dextran, and cellophane.

Of these polymers, homo- and copolymers of vinyl alcohols are preferably used in this invention. A particularly preferred one is a copolymer of vinyl alcohol and ethylene, which is available on the market, for example, under the trade name of "Eval" (produced by Kuraray Co., Ltd.).

The method of providing the oxygen-impermeable layer on the paper support according to this invention is not critical, and those procedures normally used for the formation of polymer coating films can be employed. For example, a melt-extrusion method, a liquid coating method, or a lamination method can be employed. With respect to the melt-extrusion method, it is advantageous to employ a method in which a molten polymer is extruded through a die (e.g., a T-die) provided at the outlet of an extruder and having line slits to provide an oxygen-impermeable layer on a paper support. Liquid coating methods which can be used according to the invention include a method in which a polymer is dissolved in water or an organic solvent, uniformly coated on a paper support, and dried by hot air, and a method in which a polymer emulsion is coated and then dried. Also, according to the invention, the oxygen-impermeable layer and polyolefin layers can be provided simultaneously by the co-extrusion method.

In the case of the lamination method, in addition to a method in which the oxygen-impermeable layer and the polyolefin layers are laminated sequentially, a method can be employed in which composite films comprising a plurality of layers are first formed and then are laminated.

The term "color light-sensitive material" as herein used includes so-called color papers. In addition to typical color papers, papers that can be used according to the invention also include a reversal color paper (wherein images are formed by the reversal processing) and an autopositive color paper (wherein an autopositive emulsion is used).

By the term "color image-forming layer" as herein used is meant a light-sensitive silver halide emulsion layer and/or its adjacent layer.

With respect to the color light-sensitive material of this invention, silver halide emulsion layers that can be used include a red-sensitive layer, a green-sensitive layer, and a blue-sensitive layer. Furthermore, the material can comprise of a plurality of layers.

Magenta couplers (referring to compounds which upon development react with oxidized developer to form a magenta dye) which can be used in this invention include pyrazolone-based, pyrazolinobenzimidazole-based, pyrazolotriazole-based, and indazolone-based compounds. Magenta couplers represented by the formulae (I) and (II) provide excellent photographic properties.

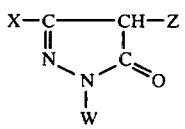
(I)

-continued

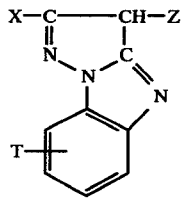
(II)

In the formula (I), W can represent hydrogen or a straight or branched alkyl (e.g., methyl, isopropyl, tert-butyl, hexyl and dodecyl), alkenyl (e.g., allyl), cyclic alkyl (e.g., cyclopentyl, cyclohexyl and norbonyl), aralkyl (e.g., benzyl and β-phenylethyl), cyclic alkenyl (e.g., cyclopentenyl and cyclohexenyl) having from 1 to 35 carbon atoms, and preferably having from 1 to 22 carbon atoms. These may be substituted by a substituent or multiple substituents, such as halogen, nitro, cyano, aryl, alkoxy, aryloxy, carboxy, alkylcarbonyl, arylcarbonyl, alkoxycarbonyl, aryloxycarbonyl, sulfo, acyloxy, sulfamoyl, carbamoyl, acylamino, diacylamino, ureido, thioureido, urethane, thiourethane, sulfonamido, heterocyclic rings, arylsulfonyloxy, alkylsulfonyloxy, arylsulfonyl, alkylsulfonyl, arylthio, alkylthio, alkylsulfinyl, arylsulfinyl, alkylamino, dialkylamino, anilino, N-arylanilino, N-alkylanilino, N-acylanilino, hydroxy and mercapto.

Furthermore, W can also represent aryl (e.g., phenyl and α- or β-naphthyl) and aryl having one or more substituents. These substituents can be, for instance, alkyl, alkenyl, cyclic alkyl, aralkyl, cyclic alkenyl, halogen, nitro, cyano, aryl, alkoxy, aryloxy, carboxy, alkylcarbonyl, arylcarbonyl, alkoxycarbonyl, aryloxycarbonyl, sulfo, acyloxy, sulfamoyl, carbamoyl, acylamino, diacylamino, ureido, thioureido, urethane, thiourethane, sulfonamido, heterocyclic, arylsulfonyloxy, alkylsulfonyloxy, arylsulfonyl, alkylsulfonyl, arylthio, alkylthio, alkylsulfinyl, arylsulfinyl, alkylamino, dialkylamino, anilino, N-alkylanilino, N-arylanilino, N-acylanilino, hydroxy and mercapto.

Furthermore, W can represent a heterocyclic ring (e.g., 5- or 6-membered heterocyclic ring or condensed heterocyclic ring containing as a hetero atom nitrogen, oxygen or sulfur, such as pyridyl, quinolyl, furyl, benzothiazolyl, oxazolyl, imidazolyl, and naphthoxazolyl), including such rings substituted by one or more substituents selected from the group of the same substituents as listed for the aryl group above.

Furthermore, W can represent acyl, thioacyl, alkylsulfonyl, arylsulfonyl, alkylsulfinyl, carbamoyl and thiocarbamoyl.

In the formulae (I) and (II), X can represent hydrogen, or a straight or branched alkyl, alkenyl, cyclic alkyl, aralkyl or cyclic alkenyl group having from 1 to 35 carbon atoms, and preferably from 1 to 22 carbon atoms. These groups may have one or more of the same substituents as listed above for W.

X can also represent aryl and a heterocyclic ring, and these may have one or more of the same substituents as listed above for W.

Furthermore, X can represent alkoxycarbonyl (e.g., methoxycarbonyl, ethoxycarbonyl and stearyloxycarbonyl), aryloxycarbonyl (e.g., phenoxycarbonyl and α- or β-naphthoxycarbonyl), aralkyloxycarbonyl (e.g., benzyloxycarbonyl), alkoxy (e.g., methoxy, ethoxy and decyloxy), aryloxy (e.g., phenoxy and tolyloxy), alkylthio (e.g., ethylthio and dodecylthio), arylthio (e.g., phenylthio and α-naphthylthio), carboxy, acylamino (e.g., acetylamido, 3-[(2,4-di-tert-amylphenoxy)acetamido]benzamido), diacylamino, N-alkylacylamino (e.g., N-methylpropionamido), N-arylacylamino (e.g., N-phenylacetamido), ureido (e.g., ureido, N-arylureido and N-alkylureido), thioureido (e.g., thioureido, N-arylthioureido and N-alkylthioureido), urethane, thiourethane, anilino (e.g., phenylamino, N-alkylanilino, N-arylanilino, N-acylanilino and 2-chloro-5-tetradecanamidoanilino), alkylamino (e.g., n-butylamino, N,N-dialkylamino and cycloalkylamino), cycloamino (e.g., piperidino and pyrrolidino), alkylcarbonyl (e.g., methylcarbonyl), arylcarbonyl (e.g., phenylcarbonyl), sulfonamido (e.g., alkylsulfonamido and arylsulfonamido), carbamoyl (e.g., N-alkylcarbamoyl, N,N-dialkylcarbamoyl, N-alkyl-N-arylcarbamoyl, N-arylcarbamoyl and N,N-diarylcarbamoyl), sulfamoyl (e.g., N-alkylsulfamoyl, N,N-dialkylsulfamoyl, N-arylsulfamoyl, N-alkyl-N-arylsulfamoyl and N,N-diarylsulfamoyl), guanidino (e.g., N-alkylguanidino and N-arylguanidino), cyano, acyloxy (e.g., tetradecyloxy), sulfonyloxy (e.g., benzenesulfonyloxy), hydroxy, mercapto, halogen and sulfo.

In the formula (II), T can represent hydrogen, or a straight or branched alkyl, alkenyl, cyclic alkyl, aralkyl or cyclic alkenyl group having from 1 to 35 carbon atoms, and preferably from 1 to 22 carbon atoms. These groups may have one or more of the same substituents as listed above for W.

T can represent an aryl or a heterocyclic ring, which may have one or more of the same substituents as listed above for W.

Furthermore, T can represent cyano, alkoxy, aryloxy, halogen, carboxy, alkoxycarbonyl, aryloxycarbonyl, acyloxy, alkylcarbonyl, arylcarbonyl, alkylthiocarbonyl, arylthiocarbonyl, sulfo, sulfamoyl, carbamoyl, acylamino, diacylamino, ureido, thioureido, urethane, thiourethane, sulfonamido, alkylsulfonyloxy, arylsulfonyloxy, arylsulfonyl, alkylsulfonyl, arylthio, alkylthio, alkylsulfinyl, arylsulfinyl, alkylamino, dialkylamino, anilino, N-arylanilino, N-alkylanilino, N-acylanilino, hydroxy and mercapto.

In the formulae (I) and (II), Z can represent hydrogen or another group which is directly bonded at the coupling position, and which is cleaved during the coupling reaction with an oxidation product of a primary amine developing agent.

The cleavable group Z contains an oxygen, nitrogen or sulfur through which it is bonded to the coupling position, or is a halogen (e.g., chlorine and fluorine).

These Z groups include groups consisting of alkyl, aryl, sulfonyl, sulfinyl, carbonyl, phosphoric acid group, thiocarbonyl, a heterocyclic ring or cyano and oxygen, nitrogen or sulfur through which they are bonded to the coupling position, and 5- or 6-membered rings containing nitrogen through which they are bonded to the coupling position.

Preferred cleavable groups Z which contain oxygen through which they are bonded to the coupling position include, for example, acyloxy (e.g., acetoxy, dodecanoyloxy, octadecanoyloxy, 3-pentadecylphenoxy, benzoyloxy, p-naphthoyloxy and 3-[γ-(2,4-di-tert-amylphenoxy)butanamido]benzoyloxy), aryloxy (e.g., phenoxy, p-chlorophenoxy, p-nitrophenoxy and naphthoxy), alkoxy, cycloalkoxy (e.g., cyclohexyloxy), hydroxamate, carbonateoxalate, heterocyclic oxy, phosphate, thiophosphate, carbamoyloxy, thiocarbamoyloxy, oxamoyloxy and thiooxamoyloxy.

Preferred cleavable groups Z which contain sulfur through which they are bonded to the coupling position include, for example, thiocyano, alkylthio (e.g., ethylthio, octylthio, phenoxypropylthio and tetrazolylthio), arylthio, heterocyclic thio, sulfonamido (e.g., benzenesulfonamido, octasulfonamido, toluenesulfonamido and 2-methoxyethoxybenzenesulfonamido), alkylsulfinyl, arylsulfinyl, heterocyclic sulfinyl, alkylsulfonyl, arylsulfonyl, heterocyclic sulfonyl, sulfo, alkylsulfonylthio, arylsulfonylthio, disulfide, sulfide, thiocarbamate, dithiocarbamate, thiocarbamate and dithiocarbonate.

Preferred cleavable groups Z which contain nitrogen through which they are bonded to the coupling position include, for example, acylamino, diacylamino, sulfonamido, sulfinamido, alkylamino, arylamino, ureido, thiouredio, phosphoric acid amido, urethane, thiocylamino, isocyanate and 5- or 6-membered heterocyclic rings containing nitrogen (e.g., cycloamino rings such as pyrrolidine, morpholine, piperazine, indoline and piperidine, cyclic diacylamino rings such as phthalimido, succinimido, saccharin, oxazolidione, thiohydantoin and hydantoin, cycloamido rings such as pyridone, oxazolidone, phthalido and valerolactam, aromatic cycloamino rings such as imidazole, pyrrole and benzotriazole, and particularly 1-piperidino, 1-imidazolyl, 1,2,4-triazol-1-yl, 1-pyrazolyl, 4-methyl-1-imidazolyl, 4-chloro-1-pyrazolyl, etc.).

In addition, other groups that can be bonded to the coupling position of the "colored couplers", such as those described in U.S. Pat. Nos. 2,455,170, 2,688,539, 2,725,292, 2,983,608 and 3,005,712, British Pat. Nos. 800,262 and 1,044,778, and so forth can be used as the Z substituent. Z can also represent those groups bonded to the coupling position of couplers that are referred to as development-controlling compound-releasing type (DIR) couplers, such as those described in U.S. Pat. Nos. 3,148,062, 3,227,554 and 3,617,291, etc., and can also represent those groups bonded to the coupling position of couplers as are described in U.S. Pat. Nos. 3,006,759, 3,214,437, 3,311,476 and 3,419,391, and so forth.

Furthermore, magenta couplers of the so-called bis-type, such as those described in Japanese Patent Application (OPI) Nos. 105820/76, 129035/78, 56024/78 and 48540/79, etc., can also be used effectively.

Of the foregoing magenta couplers, 3-anilino-5-pyrazolone type magenta couplers are particularly effective in this invention. Typical compounds of the 3-anilino-5-pyrazolone type magenta couplers are those represented by the formula (III):

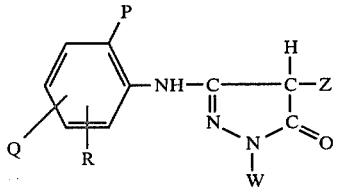

(III)

In formula (III), P represents a straight, branched or cyclic alkyl (e.g., methyl, ethyl, tert-butyl, cyclohexyl, octyl and dodecyl), a substituted or unsubstituted aryl (e.g., phenyl and tolyl), an alkyloxy containing a straight, branched or cyclic alkyl (e.g., methoxy, ethoxy, isopropoxy, cyclohexyloxy and octyloxy), a substituted or unsubstituted aryloxy (e.g., phenoxy, p-tert-butylphenoxy and naphthoxy), an N-substituted amino (e.g., methylamino, diethylamino and anilino), an amido (e.g., acetamido, butanamido, methylsulfonamido and diacylamido), halogen (e.g., fluorine, chlorine and bromine), hydroxy, cyano, or nitro group.

W represents the same substituents as defined for W of the formula (I).

Q is a hydrophobic ballast group. This hydrophobic ballast group suitably contains 4 to 35 carbon atoms (and preferably 8 to 32 carbon atoms), in order to make the coupler diffusion-resistant, and it is linked directly or through an imino, ether, carbonamido, sulfonamido, ureido, ester, imido, carbamoyl or sulfamoyl bond to the aromatic nucleus of the anilino group. Various examples of such ballast groups are indicated in the representative examples of the couplers of this invention described below.

Examples of such ballast groups include:

(1) Alkyl and alkenyl, for example, $-CH_2-CH(C_2H_5)_2$, $-C_{12}H_{25}$, $-C_{16}H_{33}$, $-C_{17}H_{33}$;

(2) Alkoxyalkyl, for example, $-(CH_2)_3-O-(CH_2)_7CH_3$, $-(CH_2)_3OCH_2-\underset{\underset{C_2H_5}{|}}{CH}-(CH_2)_8-CH_3$ as described in Japanese Patent Publication No. 27563/64;

(3) Alkylaryl, for example,

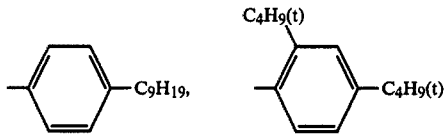

(4) Alkylaryloxyalkyl, for example,

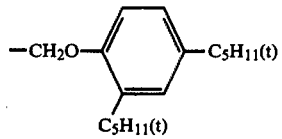

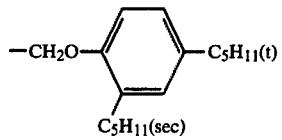

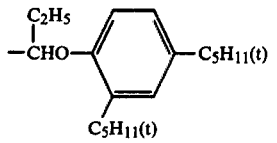

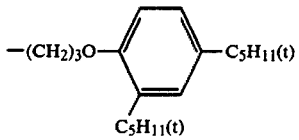

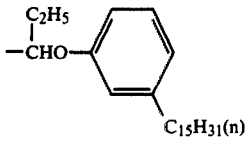

-continued

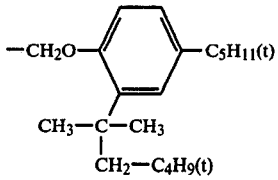

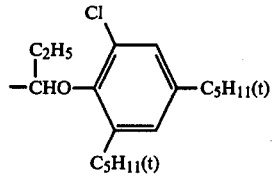

(5) Acylamidoalkyl, for example, the following groups as described in U.S. Pat. Nos. 3,337,344 and 3,418,129

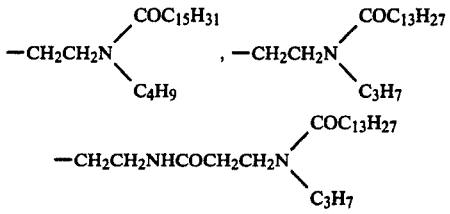

(6) Alkoxyaryl and aryloxyaryl

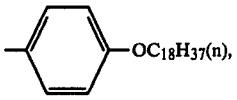

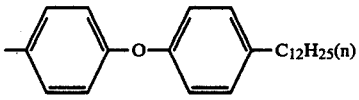

(7) Groups containing both a long aliphatic chain of alkyl or alkenyl and a water-solubilization group of sulfo, for example, $-\underset{\underset{CH_2COOH}{|}}{CH}-CH=CH-C_{16}H_{33}$, $-\underset{\underset{SO_3H}{|}}{CH}-C_{16}H_{33}$ (8) Alkyl substituted by ester, for example, $-\underset{\underset{COOC_2H_5}{|}}{CH}-C_{16}H_{33}(n)$, $-CH_2-CH_2-COOC_{12}H_{25}(n)$ (9) Alkyl substituted by aryl or heterocyclic ring, for example,

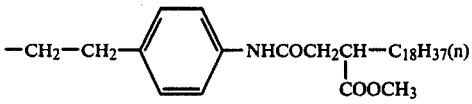

-continued
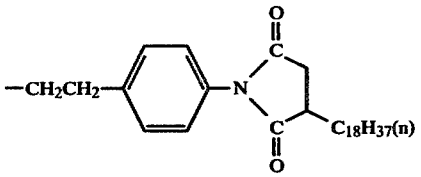
(10) Aryl substituted by aryloxyalkoxycarbonyl
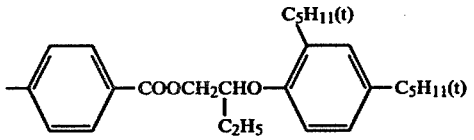
R represents hydrogen or the same groups as defined for P or Q.
Z is the same as Z of the formula (I) or (II).
The following are examples of pyrazolone type magenta couplers particularly useful in this invention, but this invention is not limited thereto:
(M-1)
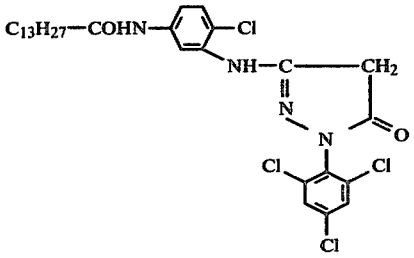
(M-2)
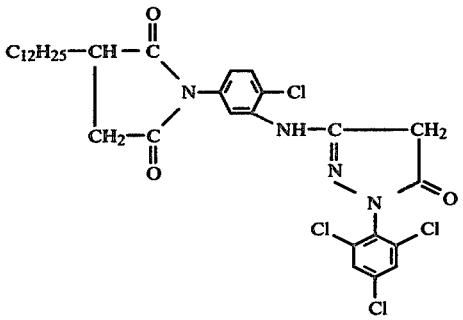
(M-3)
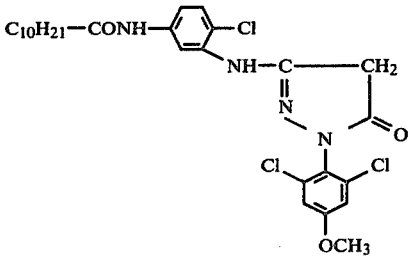
(M-4)
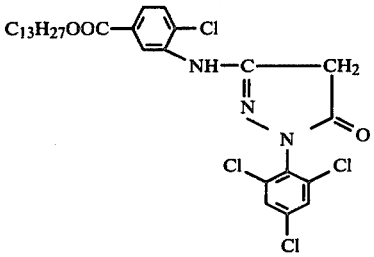
(M-5)
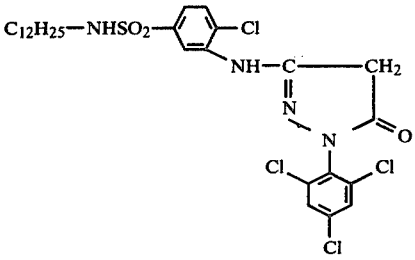

-continued
(M-6)
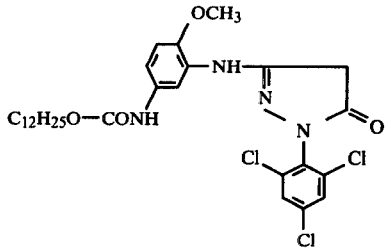
(M-7)
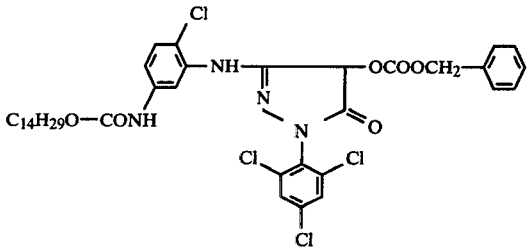
(M-8)
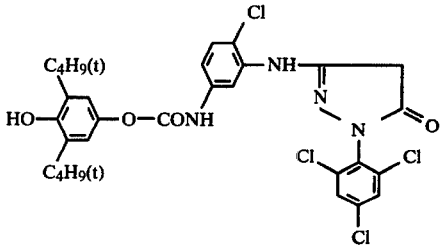
(M-9)
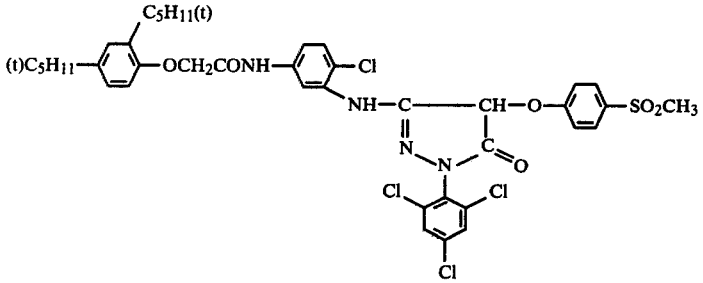
(M-10)
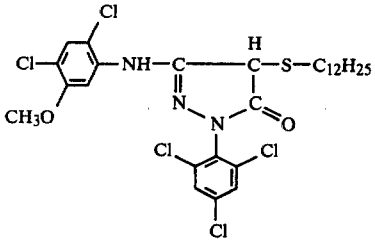
(M-11)
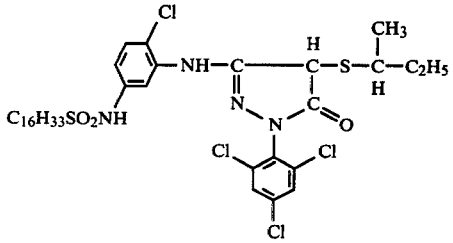
(M-12)
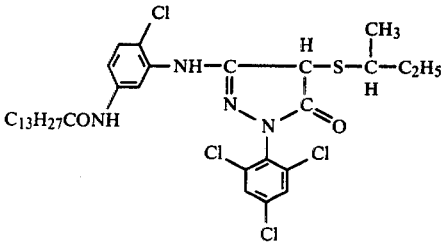

-continued
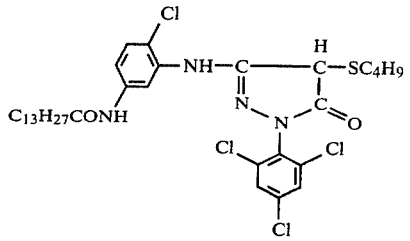
(M-13)
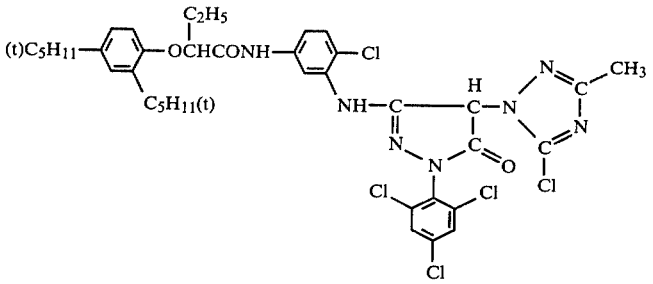
(M-14)
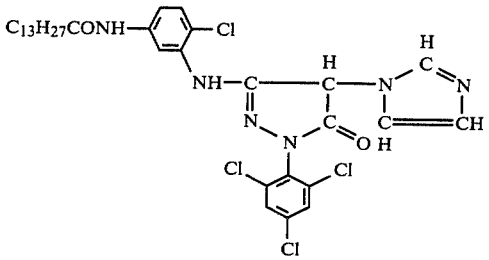
(M-15)
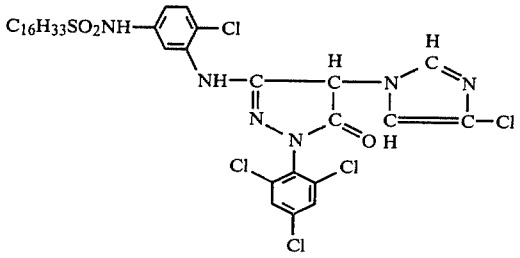
(M-16)
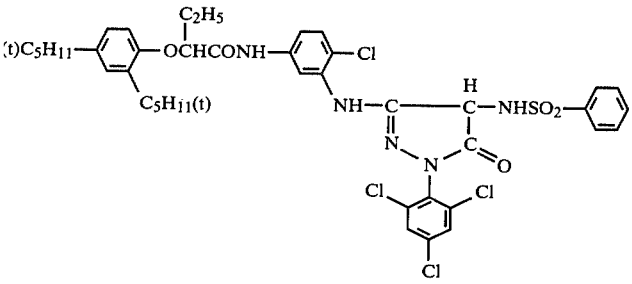
(M-17)
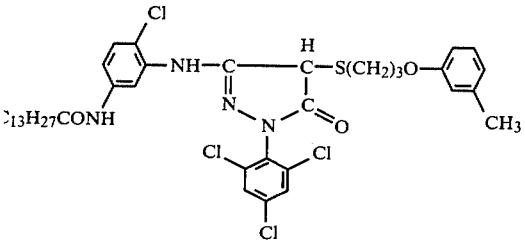
(M-18)

-continued
(M-19)
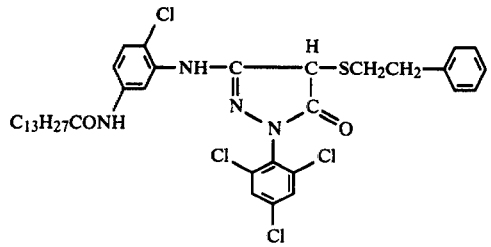
(M-20)
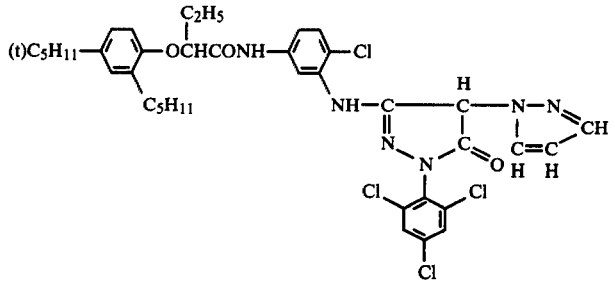
(M-21)
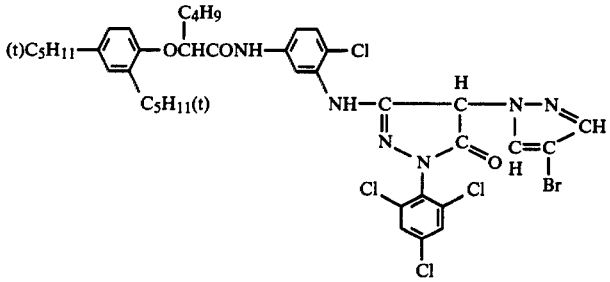
(M-22)
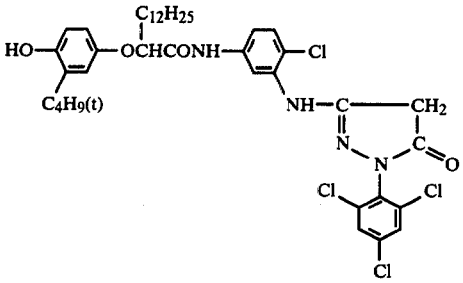
(M-23)
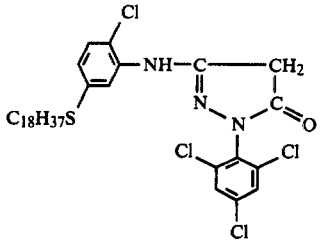
(M-24)
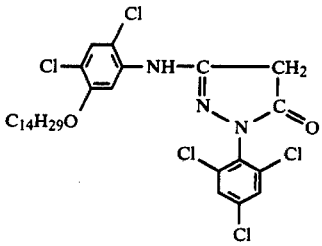

-continued (M-25)

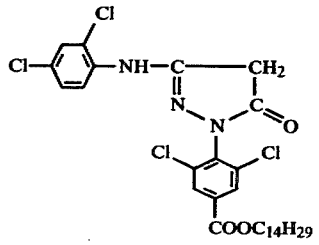

(M-26)

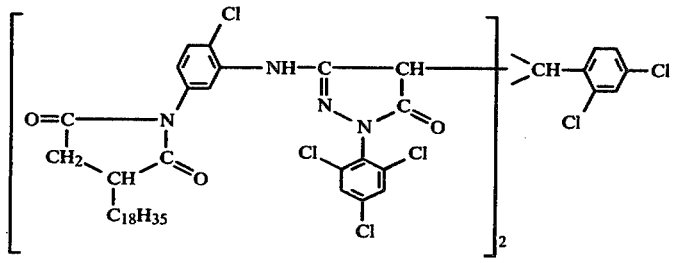

(M-27)

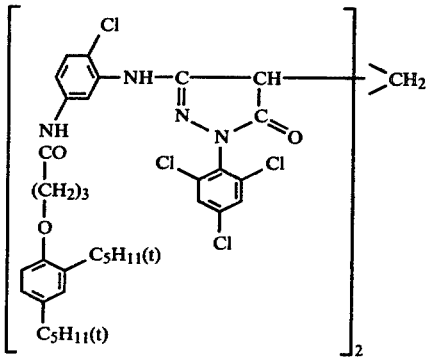

(M-28)

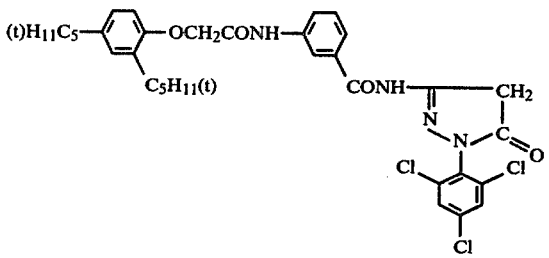

(M-29)

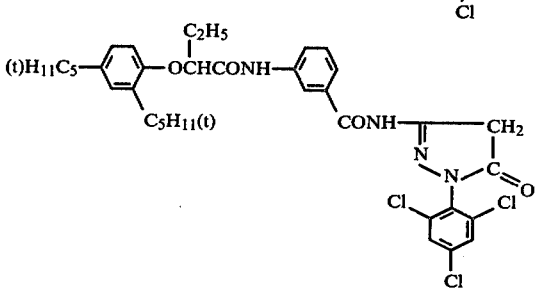

Yellow couplers that can be used in the bluesensitive layer of the color light-sensitive material according to the invention include those couplers represented by the formula (IV):

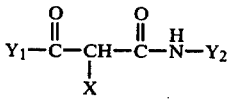

(IV)

where $Y_1$ represents an aliphatic group, an aromatic group or a heterocyclic group, $Y_2$ is an aromatic group or a heterocyclic group, and X is hydrogen or a cleavable group, which is capable of being cleaved as an anion during the oxidative coupling reaction with the oxidation product of the aromatic primary amine developer.

The aliphatic group represented by $Y_1$ can include a substituted or unsubstituted alkyl group which may be either acyclic or carbocyclic. Substituents for the alkyl group include alkenyl, aryl, alkoxy, aryloxy, acyl, amino, carboxyl, acylamino, carbamoyl, imido, alkoxycarbonyl, acyloxy, sulfo, sulfonyl, sulfonamido and sulfamoyl. These substituents themselves may have further substituents.

Examples of useful aliphatic groups include methyl, ethyl, propyl, isopropyl, butyl, isobutyl, tert-butyl, amyl, isoamyl, tert-amyl, hexyl, 1-methylpentyl, 2-methylpentyl, neopentyl, 1,1-dimethylbutyl, heptyl, 1-methylhexyl, 2-methylhexyl, 3-methylhexyl, 5-methylhexyl, 1,1-dimethylhexyl, octyl, 2-ethylhexyl, 1,1-diethylhexyl, nonyl, isononyl, decyl, undecyl, dodecyl, tetradecyl, hexadecyl, octadecyl, 1,1-dimethylnonyldecyl, 1,1-diamylhexyl, 1-methyl-1-nonyldecyl, cyclopropyl, cyclobutyl, cyclopentyl, cyclohexyl, pentyl, phenethyl, allyl, oleyl, 7,7-dimethylnorbornyl, 1-methylcyclohexyl, 2-methoxyisopropyl, 2-pentylisopropyl, 2-phenoxyisopropyl, 2-p-tert-butylphenoxyisopropyl, 2-naphthoxyisopropyl, cinnamyl, α-aminoisopropyl, α-(N,N-diethylamino)isopropyl, α-(succinimido)isopropyl, α-(phthalimido)isopropyl, α-(acetylamino)isobutyl and α-(benzenesulfonamino)isopropyl.

The aromatic groups that can be represented by $Y_1$ and $Y_2$ include a substituted or unsubstituted phenyl group. Examples of suitable substituents are monovalent substituents such as halogen, nitro, cyano, thiocyano, hydroxyl, alkoxy, aryloxy, acyloxy, alkyl, alkenyl, aryl, amino, carboxy, acyl, alkoxycarbonyl, aryloxycarbonyl, carbamoyl, acylamino, imido, sulfo, alkylsulfonyl, arylsulfonyl, alkoxysulfonyl, aryloxysulfonyl, sulfamoyl, sulfonamido, ureido and thioureido, and divalent substituents forming a condensed ring with a phenyl group. Phenyl groups having such divalent substituents are, for example, naphthyl, quinolyl, isoquinolyl, chromanyl, cumaranyl and tetrahydronaphthyl. These monovalent and divalent substituents themselves may further contain substituents.

Furthermore, the heterocyclic rings that can be represented by $Y_1$ and $Y_2$ are bonded through one of the carbon atoms forming the ring, to the carbon atom of the carbonyl group of the acyl group in α-acylacetamido, and to the nitrogen atom of the amido group, respectively. Examples of such heterocyclic groups include thiophene based, furan based, chromene based, pyrrole based, pyrazole based, pyridine based, pyrazine based, pyrimidine based, pyridazine based, indolizine based, thiazole based, imidazole based, oxazole based and oxazine based groups. These heterocyclic groups can be substituted, for example, by halogen, nitro, cyano, thiocyano, hydroxyl, alkoxyl, aryloxy, acyloxy, alkyl, alkenyl, aryl, amino, carboxy, acyl, alkoxycarbonyl, aryloxycarbonyl, carbamoyl, acylamino, imido, sulfo, alkylsulfonyl, arylsulfonyl, alkoxysulfonyl, aryloxysulfonyl, sulfamoyl, sulfonamido, ureido and thioureido.

Preferred cleavable groups include, for example, phthalimido, succinimido, maleinimido, hydantoin, glycolimido, oxazolidine-2,4-dione and thiazolidine-2,4-dione as described in Japanese Patent Application (OPI) Nos. 26133/72, 73147/73 and 6341/75, Japanese Patent Application (OPI) Nos. 104026/75 and 102636/76, Japanese Patent Publication Nos. 13576/74 and 29432/73, and Japanese Patent Application (OPI) Nos. 66835/73 and 94432/73; benzotriazole, benzimidazole, indazole, triazole, imidazole and pyrazole based compounds as described in Japanese Patent Application (OPI) Nos. 122335/74 and 66834/73; saccharin based compounds as described in Japanese Patent Publication No. 25933/73; urazol and parabanic acid based compounds as described in Japanese Patent Application (OPI) No. 66834/73; cyclic monoimido based compounds as described in Japanese Patent Application (OPI) Nos. 1229/74, 28834/75 and 34232/75; and 4-oxo-3,4-dihydro-1-H-2,1,3-benzothiadiazine-S,S-dioxide based compounds as described in Japanese Patent Application (OPI) No. 3631/76.

Two-equivalent yellow-forming couplers for use in this invention are desirably diffusion resistant. By the term "diffusion resistant" as herein used is meant that, as normally employed in connection with color-forming couplers, during the storage or development processing, the coupler is substantially fixed in the hydrophilic colloidal layer into which it was initially introduced, and it neither moves to another layer nor flows out into the processing solution.

The coupler is provided with the diffusion resistance by introducing therein at least one hydrophobic group containing in the molecule a total number of carbon atoms of at least about 8, such as an alkyl or alkylaryl, by conventional procedures. A number of such hydrophobic groups are known in the art, and any of them can be used in this invention. In two-equivalent yellow-forming couplers for use in this invention, such a hydrophobic group can be introduced into at least one of $Y_1$, $Y_2$ and the cleavable group of the formula (IV).

Two-equivalent yellow color-forming couplers wherein in the formula (IV) $Y_1$ is an alkyl group bonded through a tertiary carbon atom to the carbonyl group, and particularly tert-butyl, are preferred.

Furthermore, yellow color-forming couplers wherein in the formula (IV) $Y_2$ is a phenyl or a phenyl substituted by halogen, trifluoromethyl, amino, acylamino, sulfonamido, ureido, alkyl, alkoxy, aryloxy, carboxy, alkoxycarbonyl, carbamoyl, sulfo, sulfamoyl or imido, and particularly those compounds represented by the formula (V) below are preferred:

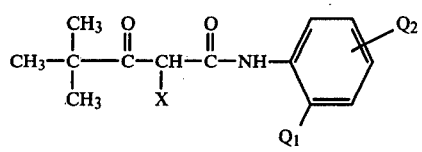

(V)

In formula (V), $Q_1$ is halogen, alkoxy, aryloxy, dialkylamino or alkyl, $Q_2$ is positioned at 4- or 5-position of the anilido nucleus and is halogen, trifluoromethyl, acylamino, sulfonamido, ureido, alkyl, alkoxy, aryloxy, carboxy, alkoxycarbonyl, carbamoyl, sulfo, sulfamoyl or imido, and X is the same as in the formula (IV).

Typical examples of such yellow color-forming couplers which can be used in this invention are shown below:

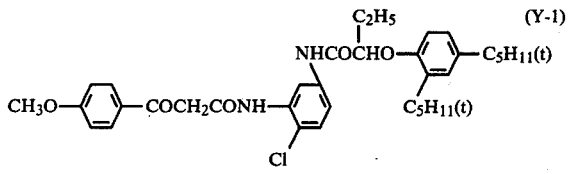

(Y-1)

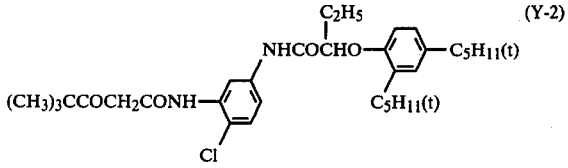

(Y-2)

-continued (Y-3)

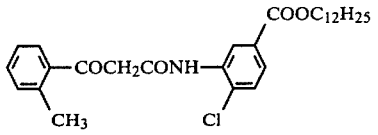

(Y-4)

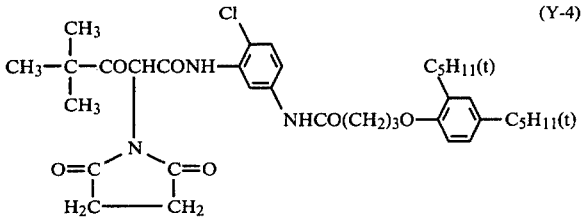

(Y-5)

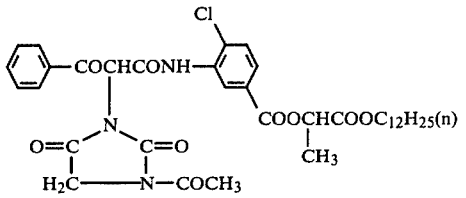

(Y-6)

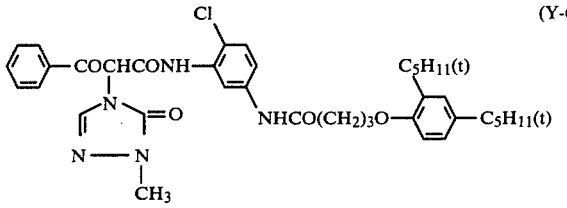

(Y-7)

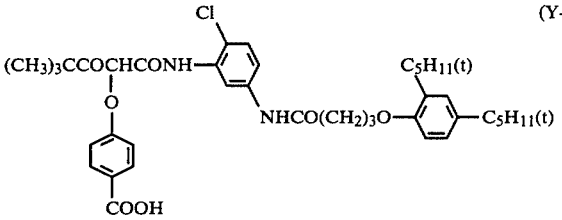

(Y-8)

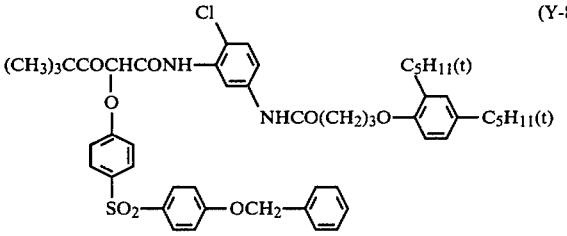

(Y-9)

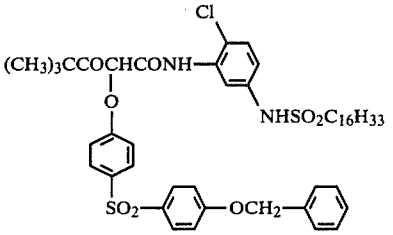

(Y-10)

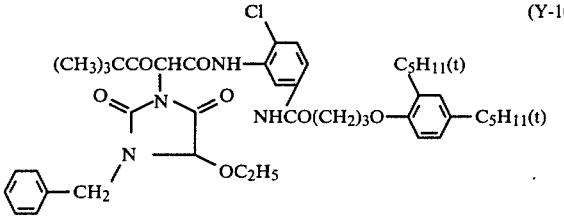

-continued (Y-11)

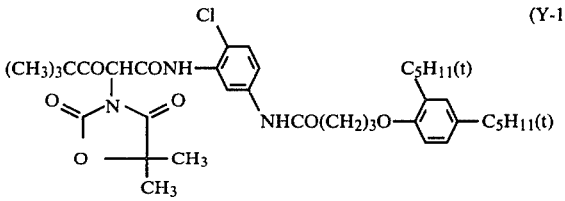

Hydrophobic cyan couplers which are suitable for use in the invention include hydrophobic phenol or naphthol based couplers as described, for example, in Japanese Patent Publication No. 27563/64, British Pat. No. 562,205, U.S. Pat. Nos. 2,474,293, 2,895,826, 3,582,322, 2,908,573, 3,476,563, 3,619,196, 2,423,730, 2,801,171, 3,046,129, 3,516,831, 3,311,476, 3,253,294, 3,458,315, 3,227,550, 3,419,390, 3,034,892, 2,772,162, 2,322,027, 3,779,763, 3,632,347, 3,652,286 and 3,591,383, and German Patent Application (OLS) No. 2,207,468.

Phenol or naphthol based cyan couplers that can be used in this invention include compounds represented by the formulae (VI) and (VII):

(VI)

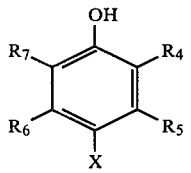

(VII)

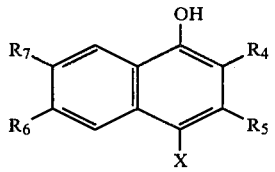

In these formulae, $R_4$ represents hydrogen, an aliphatic group containing not more than 30 carbon atoms (e.g., alkyl such as methyl, isopropyl, pentadecyl and eicosyl), an alkoxy group containing not more than 30 carbon atoms (e.g., methoxy, isopropoxy, pentadecyloxy and eicosyloxy), an aryloxy group (e.g., phenoxy and p-tert-butylphenoxy), an acylamido group, a sulfonamido group, a phosphoric acid amido group and a ureido group, respectively, represented by the formulae (VIII), (IX), (X) and (XI), or a carbamyl group represented by the formula (XII) or (XIII).

$-NH-CO-B$ (VIII)

$-NH-SO_2-B$ (IX)

(X)

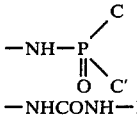

$-NHCONH-B$ (XI)

$-CONH-B$ (XII)

(XIII)

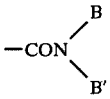

In the above formulae, B and B′ may be the same or different, and each represents an aliphatic group containing 1 to 32 carbon atoms, preferably a straight or branched alkyl groups containing 1 to 20 carbon atoms, a cyclic alkyl group (e.g., cyclopropyl, cyclohexyl and norbornyl), or an aryl group (e.g., phenyl and naphthyl). These alkyl and aryl groups may be substituted by halogen (e.g., fluorine and chlorine), nitro, cyano, hydroxyl, carboxyl, amino (e.g., amino, alkylamino, dialkylamino, anilino and N-alkylanilino), alkyl (e.g., those listed for $R_4$), aryl (e.g., phenyl and acetylaminophenyl), alkoxycarbonyl (e.g., tetradecyloxycarbonyl), acyloxycarbonyl, amido (e.g., acetamido and methanesulfonamido), imido (e.g., succinimido), carbamoyl (e.g., N,N-dihexylcarbamoyl), sulfamoyl (e.g., N,N-diethylsulfamoyl), alkoxy (e.g., ethoxy, tetradecyloxy and octadecyloxy), or aryloxy (e.g., phenoxy, p-tert-butylphenoxy, 2,4-diamylphenoxy and 4-hydroxy-3-tert-butylphenoxy).

C and C′ can each be B, —OB, —NH—B or —$NB_2$, and B is the same as previously defined above.

Also in the above formulae (VI) and (VII), $R_5$, $R_6$ and $R_7$ can each represent hydrogen, halogen, alkyl, aryl, alkoxy, alkylthio, a heterocyclic group, amino, carbonamido, sulfonamido, sulfamyl or carbamyl, including, for example, the following groups: hydrogen, halogen (e.g., chloro and bromo), primary, secondary or tertiary alkyl containing 1 to 22 carbon atoms (e.g., methyl, propyl, isopropyl, n-butyl, sec-butyl, tert-butyl, hexyl, dodecyl, 2-chlorobutyl, 2-hydroxyethyl, 2-phenylethyl, 2-(2,4,6-trichlorophenyl)ethyl, 2-aminoethyl (iso)$C_3F_7$- and $C_6F_{12}H$-), alkylthio (e.g., hexadecylthio), aryl (e.g., phenyl, 4-methylphenyl, 2,4,6-trichlorophenyl, 3,5-dibromophenyl, 4-trifluoromethylphenyl, 2-trifluoromethylphenyl, 3-trifluoromethylphenyl, naphthyl, 2-chloronaphthyl and 3-ethylnaphthyl), heterocyclic groups (e.g., benzofuranyl, furanyl, thiazolyl, benzothiazolyl, naphthothiazolyl, oxazolyl, benzoxazolyl, naphthoxazolyl, pyridyl, and quinolinyl), amino (e.g., amino, methylamino, diethylamino, dodecylamino, phenylamino, tolylamino and 4-(3-sulfobenzamido)anilino, 4-cyanophenylamino, 2-trifluoromethylphenylamino and benzothiazoleamino), carbonamido (e.g., alkylcarbonamido such as ethylcarbonamido and decylcarbonamido, arylcarbonamido such as phenylcarbonamido, 2,4,6-trichlorophenylcarbonamido, 4-methylphenylcarbonamido, 2-ethoxyphenylcarbonamido, 3-[α-(2,4-di-tert-amylphenoxy)acetamido]benzamido and naphthylcarbonamido, and heterocyclic carbonamido such as thiazolylcarbonamido, benzothiazolylcarbonamido, naphthothiazolylcarbonamido, oxazolylcarbonamido, benzoxazolylcarbonamido, imidazolylcarbonamido and benzimidazolylcarbonamido), sulfonamido (e.g., alkylsulfonamido such as butylsulfonamido, dodecylsulfonamido and phenylethylsulfonamido, arylsulfonamido such as phenylsulfonamido, 2,4,6-trichlorophenylsulfonamido, 2-methoxyphenylsulfonamido, 3-carboxyphenylsulfonamido and naphthylsulfonamido, and heterocyclic sulfonamido such as thiazolylsulfonamido, benzothiazolylsulfonamido, imidazolylsulfonamido and pyridylsulfonamido), sulfamyl (e.g., alkylsulfamyl such as propylsulfamyl, octylsulfamyl, pentadecylsulfamyl and octadecylsulfamyl, arylsulfamyl such as phenylsulfamyl, 2,4,6-trichlorophenylsulfamyl, 2-methoxyphenylsulfamyl and naphthylsulfamyl, and heterocyclic sulfamyl such as thiazolylsulfamyl, benzothiazolylsulfamyl, oxazolylsulfamyl, benzimidazolylsulfamyl and pyridylsulfamyl), and carbamyl (e.g., alkylcarbamyl such as ethylcarbamyl, octylcarbamyl, pentadecylcarbamyl and octadecylcarbamyl, arylcarbamyl such as phenylcarbamyl and 2,4,6-trichlorophenylcarbamyl, and heterocyclic carbamyl such as thiazolylcarbamyl, benzothiazolylcarbamyl, oxazolylcarbamyl, imidazolylcarbamyl and benzimidazolylcarbamyl).

X is hydrogen or a coupling cleavable group (e.g., halogen, thiocyano, acyloxy, alkoxy, aryloxy and cyclic imido).

Hydrophobic cyan couplers for use in the color light-sensitive material of this invention are not limited to the compounds represented by the formulae (VI) and (VII), and they can be chosen over a wide range. In general, phenol-based compounds are advantageously used as cyan couplers. According to the invention, it is sufficient to use one kind of hydrophobic cyan coupler, but two or more phenol or naphthol-based compounds can also be used. Moreover, a phenol-based compound can be used in combination with a naphthol-based compound.

Examples of cyan couplers which are used in this invention are shown below, but this invention is not limited thereto.

(C-1)

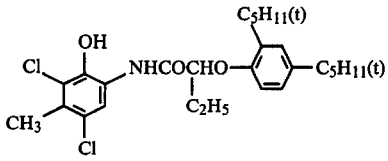

(C-2)

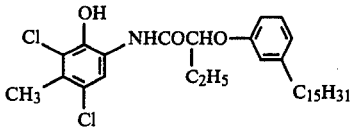

(C-3)

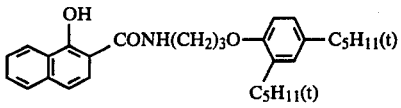

(C-4)

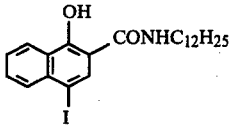

(C-5)

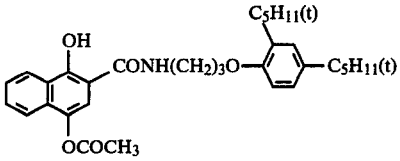

(C-6)

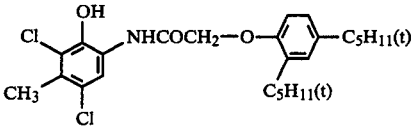

(C-7)

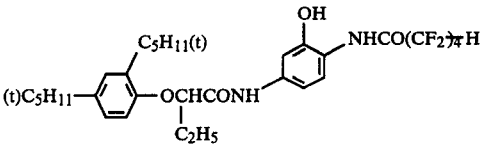

(C-8)

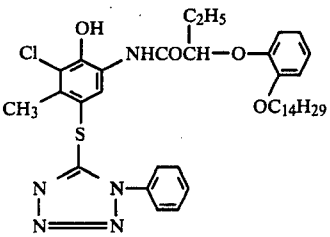

-continued

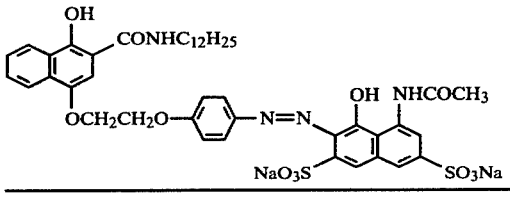

(C-9)

The method of adding the coupler to the silver halide emulsion layer or other hydrophilic colloidal layers is not critical in the invention, and conventional dispersion method can be employed.

Typical examples of high boiling point solvents which are used for the dispersion of the coupler are described below, but the invention is not limited thereto.

Solvents as described in U.S. Pat. No. 3,676,137 can be used, such as butyl phthalate, dinonyl phthalate, butyl benzoate, diethylhexyl sebacate, butyl stearate, dinonyl maleate, tributyl citrate, tricresyl phosphate and dioctylbutyl phospate, dioctyl adipate, 3-ethylbiphenyl, and liquid dye stabilizers as described, for example, in *Product Licensing Index,* Vol. 83, pp. 26–29 (March, 1971) under the Title of "Improved Photographic Dye Image Stabilizer".

Low boiling point organic solvents which can be used as auxiliary solvents in combination with such high boiling point organic solvents include ethyl acetate, butyl acetate, ethyl propionate, ethyl formate, butyl formate, nitromethane, carbon tetrachloride, chloroform, hexane, cyclohexane, ethylene glycol, acetone, ethanol, dimethylformamide and dioxane. Furthermore, to these solvents, toluene, xylene and the like can be added.

The silver halide emulsion for use in this invention can be prepared by methods as described in P. Glafkides, *Chimie et Physique Photographique,* Paul Montel (1967), G. F. Duffin, *Photographic Emulsion Chemistry,* The Focal Press (1966), V. L. Zelikman et al., *Making and Coating Photographic Emulsion,* The Focal Press (1964), etc.; known methods can be used, used as acidic methods, neutral methods, and ammonia methods, etc. The reaction of soluble silver salts and soluble halogen salts can be effected by known methods, such as a single jet mixing method, a double jet mixing method, a combination thereof, etc.

A method of forming particles in the presence of an excess of silver ions (the so-called reverse mixing method) can also be employed. Among the simultaneous mixing methods, a method wherein pAg in a liquid phase in which silver halide is formed is kept constant (that is, a controlled double jet method) can be employed. This method permits the formation of a silver halide emulsion having regular crystal shapes and nearly uniform particle size.

Two or more separately formed silver halide emulsions may be mixed and used.

During the formation of silver halide particles or during physical aging, cadmium salts, zinc salts, lead salts, thallium salts, iridium salts or their complex salts, rhodium salts or its complex salts, iron salts or its complex salts, etc., can be allowed to coexist therewith. The inner part and the surface layer of silver halide particle may have different phases or may be comprised of a uniform phase. Moreover, the silver halide particles may be those wherein latent images are mainly formed on the surface thereof, or those wherein they are mainly formed in the inner part thereof.

It is advantageous to use gelatin as a binder or protective colloid for the photographic emulsion, but other hydrophilic colloids can be used. For example, gelatin derivatives, graft polymers of gelatin and other polymers, proteins such as albumin and casein, cellulose derivatives such as hydroxyethyl cellulose, carboxymethyl cellulose and cellulose sulfuric acid esters, sodium alginate, sugar derivatives such as starch derivatives, and various hydrophilic synthetic polymers such as homo-or copolymers, e.g., polyvinyl alcohol, partly acetalated polyvinyl alcohol, poly-N-vinylpyrrolidone, polyacrylic acid, polymethacrylic acid, polyacrylamide, polyvinyl imidazole and polyvinyl pyrazole can be used.

In addition to lime-treated gelatin, acid-treated gelatin and enzyme-treated gelatin may also be used. When using the acid-treated gelatin, either an acid-treated gelatin having a high jelly strength and an acid-treated gelatin having a low viscosity can be used.

Various other compounds can be incorporated into the photographic emulsion for use in the invention, for the purpose of preventing fog during the production, storage or photographic processing of the light-sensitive material or stabilizing photographic performance. Many compounds known as anti-foggants or stabilizers, such as azoles, e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole); mercaptopyrimidines; mercaptotriazines; thioketo compounds, e.g., oxazolinethione; azaindenes, e.g., triazaindenes, tetraazaindenes (particularly 4-hydroxy substituted (1,3,3a,7) tetrazaindenes) and pentaazaindenes; benzenethiosulfonic acid; benzenesulfinic acid and benzenesulfonic acid amide can also be incorporated. For example, compounds as described in U.S. Pat. Nos. 3,954,474 and 3,982,947, and Japanese Patent Publication No. 28660/77 can be used.

For the purpose of increasing sensitivity and contrast or accelerating development, the silver halide photographic emulsion for use in this invention may contain, for example, polyalkylene oxide or its ether, ester, amine and like derivatives, thioether compounds, thiomorpholines, tertiary ammonium salt compounds, urethane derivatives, urea derivatives, imidazole derivatives and 3-pyrazolidones. For example, those described in U.S. Pat. Nos. 2,400,532, 2,423,549, 2,716,062, 3,617,280, 3,772,021 and 3,808,003, and British Patent 1,488,991, can be used.

The silver halide photographic emulsion layers or other hydrophilic colloidal layers of this invention may contain stilbene-based, triazine-based, oxazole-based, cumarin-based or the like brighteners. These brighteners may be water-soluble, or water-insoluble brighteners may be used in a dispersion form. Representative examples of fluorescent brighteners are described in U.S. Pat. Nos. 2,632,701, 3,269,840 and 3,359,102, British Pat. Nos. 852,075 and 1,319,763, etc.

The silver halide emulsion of this invention may be spectrally sensitized by methine dyes and the like. Dyes which can be used include cyanine dyes, merocyanine dyes, composite cyanine dyes, composite merocyanine dyes, holopolar cyanine dyes, hemicyanine dyes, styryl dyes and hemioxonol dyes. Particularly useful dyes are cyanine dyes, merocyanine dyes, and composite merocyanine dyes.

In these dyes, any of the nuclei which are usually utilized as basic heterocyclic nuclei in cyanine dyes can be used. Examples of such nuclei are pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, etc.; those nuclei wherein alicyclic hydrocarbon rings are fused onto the nuclei as described above; those nuclei wherein aromatic hydrocarbon rings are fused onto the nuclei as described above, i.e., indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus, quinoline nucleus and the like. These nuclei may be substituted on carbon atoms.

In merocyanine dyes or composite merocyanine dyes, nuclei having a ketomethylene structure, 5- or 6-membered heterocyclic nuclei such as pyrazoline-5-one nucleus, thiohydantoin nucleus, 2-thioxazolidine-2,4-dione nucleus, thiazolidine-2,4-dione nucleus, rhodanine nucleus and thiobarbituric acid nucleus can be used.

Useful sensitizing dyes are described, for example, in German Pat. No. 929,080, U.S. Pat. Nos. 2,231,658, 2,493,748, 2,503,776, 2,519,001, 2,912,329, 3,656,959, 3,672,897, 3,694,217, 4,025,349, and 4,046,572, British Pat. No. 1,242,588, and Japanese Patent Publication Nos. 14030/79 and 2484/77.

These sensitizing dyes may be used singly or in combination with each other. Combinations of sensitizing dyes are often employed particularly for intensive color sensitization. Typical examples are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Pat. Nos. 1,344,281 and 1,507,803, Japanese Patent Publication Nos. 4936/68 and 12375/78, Japanese Patent Application (OPI) Nos. 10618/77 and 109925/77.

In combination with the sensitizing dye, dyes having no spectral sensitization action by themselves or those substances which do not materially absorb visible light, but cause intensive sensitization, may be added to the emulsion. For example, aminostilbene compounds substituted by nitrogen-containing heterocyclic rings (described, for example, in U.S. Pat. Nos. 2,933,390 and 3,635,721), condensates of aromatic organic acids and formaldehyde (described, for example, in U.S. Pat. No. 3,743,510), cadmium salts, azaindene compounds, etc., may be added. Combinations described in U.S. Pat. Nos. 3,615,613, 3,615,641, 3,617,295 and 3,635,721 are particularly useful.

The color light-sensitive material of this invention may contain, as anti-color-foggants, hydroquinone derivatives, aminophenol derivatives, gellic acid derivatives, ascorbic acid derivatives, etc. Representative examples of such anti-color-foggants are described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77, Japanese Patent Publication No. 23813/75, etc.

The hydrophilic colloidal layer of the color light-sensitive material of this invention may contain an ultraviolet ray-absorbing agent. For example, arylsubstituted benzotriazole compounds (for example, those described in U.S. Pat. No. 3,533,794), 4-thiazolidone compounds (for example, those described in U.S. Pat. Nos. 3,314,794 and 3,352,681), benzophenone compounds (for example, those described in Japanese Patent Application (OPI) No. 2784/71), cinnamic acid ester compounds (for example, those described in U.S. Pat. Nos. 3,705,805 and 3,707,375), butadiene compounds (for example, those described in U.S. Pat. No. 4,045,229), and benzoxyzole compounds (for example, those described in U.S. Pat. No. 3,700,455) can be used. In addition, those described in U.S. Pat. No. 3,499,762 and Japanese Patent Application (OPI) No. 48535/79 can be used. Ultraviolet ray-absorbing couplers (e.g., α-naphthol-based cyan dye-forming couplers) and ultraviolet ray-absorbing polymers can also be used. These ultraviolet ray-absorbing agents may be mordanted to a specific layer. A layer containing these ultraviolet ray-absorbing agents is usually provided on a magenta coupler-containing green-sensitive emulsion layer, but it is preferred to provide it on the above green-sensitive emulsion layer and a cyan coupler-containing red-sensitive emulsion layer.

In the practice of this invention, known anti-fading agents can also be used. Color image stabilizers for use in this invention can be used alone or in admixtures thereof.

Known anti-fading agents include hydroquinone derivatives as described in U.S. Pat. Nos. 2,360,290, 2,418,613, 2,675,314, 2,701,197, 2,704,713, 2,728,659, 2,732,300, 2,735,765, 2,710,801 and 2,816,028, British Pat. No. 1,363,921, etc.; gallic acid derivatives as described in U.S. Pat. Nos. 3,457,079 and 3,069,262, etc.; p-alkoxyphenols as described in U.S. Pat. Nos. 2,735,765 and 3,698,909, Japanese Patent Publication Nos. 20977/74 and 6623/77; p-oxyphenol derivatives as described in U.S. Pat. Nos. 3,432,303, 3,573,050, 3,574,627 and 3,764,337, Japanese Patent Application (OPI) Nos. 35633/77, 147434/77 and 152225/77; bisphenols as described in U.S. Pat. No. 3,700,455; ethers of hydroquinones as described in Japanese Patent Application (OPI) Nos. 48538/79, 70036/79, etc.; ethers of cumarones as described in Japanese Patent Application (OPI) No. 17729/78; etc.

Into the hydrophilic colloidal layer of the color light-sensitive material of this invention can be, as necessary, incorporated a gelatin hardener, a surfactant, a matting agent, a chemical stabilizer, and the like. Such additives are described, for example, in *Research Disclosure,* Vol. 176, pp. 21–31 (December 1978).

Film thicknesses of light-insensitive colloidal layers such as a protective layer and an intermediate layer of the present color light-sensitive material are in a range of 0.1 to 10 μm, preferably 0.4 to 4 μm. These light-insensitive hydrophilic colloidal layers may each be comprised of two or more layers.

For the photographic processing of the light-sensitive material of this invention, known mehtods can be employed. Known processing solutions can be employed. The processing temperature is ordinarily chosen within a range of 18° C. to 50° C., but it may be lower than 18° C. or higher than 50° C. A particularly preferred temperature range is from 24° C. to 45° C.

Conventional processing methods can be employed for the formation of dye images. A negative-positive process (for example, as described in *Journal of the Society of Motion Picture and Television Engineers,* Vol. 61, pp. 667–701 (1953)), a color reversal process in which negative silver images are formed by developing with a developer containing a black-white developing agent, are subjected to at least one uniform exposure or another suitable fog treatment, and subsequently are subjected to color development to obtain positive dye images, a direct color reversal process in which an autopositive emulsion is used and positive dye images are formed only by application of direct color development processing, etc., are used.

Developers for use in the black-white photographic processing can contain known developing agents. Such developing agents include dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid and heterocyclic compounds as described in U.S. Pat. No. 4,067,872 which are similar to the condensates for 1,2,3,4-tetrahydroquinoline ring and indolenine ring. They can be used singly or in combination with each other.

In general, the developer also contains known preservatives, alkali agents, pH buffers, anti-foggants and the like, and furthermore, as necessary, it may contain auxiliary dissolving agents, toning agents, development accelerators, surfactants, anti-foaming agents, hard water-softening agents, hardeners, tackifiers and the like.

The color developer generally comprises an alkaline aqueous solution containing a color developing agent. Color developing agents which can be used for this purpose include known aromatic primary amine developers such as 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc. In addition, those described in L. F. A. Mason, *Photographic Processing Chemistry,* pp. 226–229, Focal Press (1966), U.S. Pat. Nos. 2,193,015 and 2,592,364, Japanese Patent Application (OPI) No. 64933/73, etc., can be used.

The color developer can further contain a pH buffer such as sulfite, carbonate, borate and phosphate of alkali metal, a development controlling agent or anti-foggant such as bromide, iodide and an organic anti-foggant, etc. As necessary, it may contain a hard water-softening agent, a preservative such as hydroxyamine, an organic solvent such as benzylalcohol and diethylene glycol, a development accelerator such as polyethylene glycol, tertiary ammonium salt and amines, a dye-forming coupler, a competitive coupler, a fogging agent such as sodium borohydride, an auxiliary developer such as 1-phenyl-3-pyrazolidone, a tackifier, a polycarboxylic acid-based chelating agent as described in U.S. Pat. No. 4,083,723, an antioxidant as described in West German Patent Application (OLS) No. 2,622,950, etc.

Fixers having generally used compositions can be used in this invention. As fixing agents, there can be used, in addition to thiosulfate and thiocyanate, organic sulfur compounds which are known to have a fixing effect. The fixer may contain water-soluble aluminum salts as hardeners.

After the color development, the photographic emulsion layer is usually subjected to a bleach processing. The bleach processing may be carried out simultaneously with a fixing processing or they may be carried out separately.

Bleaching agents which can be used in this invention include polyvalent metal (e.g., iron (III), cobalt (III), chromium (VI) and copper (II)) compounds, peroxides, quinones, and nitroso compounds. For example, ferricyanides, dichromic acid salts, organic complex salts of iron (III) or cobalt (III), for example, aminopolycarboxylic acid (e.g., ethylenediaminetetraacetic acid, nitrilotriacetic acid and 1,3-diamino-2-propanol tetraacetic acid) or organic acid (e.g., citric acid, tartaric acid and malic acid) complex salts, persulfuric acid salts, permanganic acid salts, nitrosophenol, etc., can be used. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful both for an independent bleaching solution and for a one-bath bleach-fixing solution.

Bleach or bleach-fixing solutions can contain bleach accelerators, as described in U.S. Pat. Nos. 3,042,520, 3,241,966, Japanese Patent Publication Nos. 8506/70, 8836/70, etc., thiol compounds as described in Japanese Patent Application (OPI) No. 65732/78, and various other known additives.

The light-sensitive material obtained according to this invention may be processed with those developers which are supplied or controlled by the procedures described in Japanese Patent Application (OPI) Nos. 84636/76, 119934/77, 46732/78, 9626/79, 19741/79 and 37731/79, Japanese Patent Application Nos. 76158/79, 76159/79, and 102962/79.

Bleach-fixing solutions which are used for the light-sensitive material produced by this invention may be those reproduced by procedures described in Japanese Patent Application (OPI) Nos. 781/71, 49437/73, 18191/73, 145231/75, 18541/76, 19535/76 and 144620/76, and Japanese Patent Publication No. 23178/76.

The color light-sensitive material of this invention is particularly useful when subjected to so-called two-bath processing. By the term "two-bath processing" as herein used is meant that a color light-sensitive material is processed only in two baths of a color developer and a bleach-fixing solution, and it is not processed in a stabilization processing bath.

As previously described, although the two-bath processing is markedly advantageous for the rapid processing of color light-sensitive material, it has a serious defect in that it produces dye images which are subject to discoloration and fading. With the color light-sensitive material of this invention, however, when it is subjected to the two-bath processing, the discoloration and fading is markedly reduced.

As was previously noted, incorporation of benzyl alcohol into the color developer in an amount of 1 to 30 ml/l, particularly 3 to 20 ml/l permits the acceleration of color development and is advantageous for the rapid processing of color light-sensitive material, but suffers from the serious defect that it facilitates the discoloration and fading of formed dye images.

The color light-sensitive material of this invention has the advantage that even when it is subjected to the rapid processing by use of a color developer containing such benzyl alcohol, the discoloration and fading of formed dye images is still markedly reduced.

Japanese Patent Application (OPI) No. 121728/79 discloses a technique similar to this invention, in which a water-permeable layer having an oxygen permeability of 20 ml/m$^2$·hr·atm or less is provided on the outer surface of a silver halide emulsion layer to improve the discoloration and fading of dye images produced. However, it has now been found that with regard to the influence of oxygen on the discoloration and fading of dye images, the influence of oxygen coming through the paper support is, unexpectedly, greater than that of oxygen permeating from the surface of the silver halide emulsion layer, and thus this invention has now been developed.

As previously described, if the color image-forming layer is completely shielded from oxygen, the fading by light of cyan is instead facilitated. In this invention, therefore, a surface protective layer containing (as the main binder) a polymer having a suitable oxygen permeability (such as gelatin) is provided on the surface of the light-sensitive material on the same side as that on which the color image-forming layer is provided.

The oxygen permeability of the surface protective layer is preferably 2.0 to 500 ml/m$^2$·hr·atm (28° C., dry state), particularly 5.0 to 50 ml/m$^2$·hr·atm (28° C., dry state). A preferred binder for use in the surface protective layer is gelatin, and it is preferred that it constitutes 80% by weight or more of the total binder.

Polymers which can be used in combination with gelatin include the hydrophilic colloids as previously listed as binders for the silver halide emulsion.

As described above, the fading by light of cyan color images is lowered by the presence of oxygen. Therefore, it is preferred that the cyan color image-forming layer be provided on the yellow and magenta color image-forming layers, but one of the yellow and magenta color image-forming layers may be present on the cyan color image-forming layer.

The color light-sensitive material of this invention can be, after color development, provided with a waterproof coating film comprising a polymer, wax, oil, a surfactant, lipid, and the like, on the same side on which the emulsion layer(s) is provided. For providing such a waterproof coating film, the following can be employed:

(1) A solution of a compound having water-shielding properties in a solid state is coated by dip coating, rod coating, gravure coating, extrusion coating, spray coating or the like and then dried.

(2) A dispersion of a latex having water-shielding properties in a solid state is coated in the same manner as in (1) and then dried.

(3) A compound having water-shielding properties in a solid state is melted, coated in the same manner as in (1), and cooled.

(4) A transparent film having water-shielding properties is bonded to the surface of the color light-sensitive material with a heat- or pressure-sensitive adhesive.

The following examples illustrate this invention in greater detail.

EXAMPLE 1

A mixture of 100 g of polyethylene and 15 g of titanium dioxide was melted at about 300° C. and extrusion-coated in an amount of 25 g/m$^2$ on one surface of a paper support used for usual color photographic paper. On the back surface of the paper support was melt extrusion-coated only polyethylene in an amount of 25 g/m$^2$ to provide a double-side polyethylene laminated paper (hereinafter referred to as "Laminated Paper A"). The 1st, 2nd, 3rd, 4th, 5th and 6th layers as illustrated in Table 1 were successively coated on Laminated Paper A in this order to produce a color light-sensitive material (Sample 100).

A coating solution for the 1st layer was prepared as follows:

A yellow coupler (*6) in the amount of 100 g was dissolved in a mixture of 100 ml of dibutyl phthalate and 200 ml of ethyl acetate, the resultant solution was emulsified and dispersed in 800 g of a 10% gelatin aqueous solution containing 80 ml of a 1% sodium dodecylbenzenesulfonate aqueous solution, and then the resultant emulsion was mixed with 1,450 g (containing 70 L g of Ag) of a blue-sensitive silver chlorobromide emulsion (Br 80 mol%) to obtain the coating solution.

As a sensitizing agent for each emulsion, the following were employed:

Blue-Sensitive Emulsion: 3,3'-Di(γ-sulfopropyl)-selenacyanine sodium salt ($2\times10^{-4}$ mol per mol of silver halide)

Green-Sensitive Emulsion: 3,3'-Di(γ-sulfopropyl)-5,5'-diphenyl-9-ethyloxacarbocyanine sodium salt ($2.5\times10^{-4}$ mol per mol of silver halide)

Red-Sensitive Emulsion: 3,3'-Di(γ-sulfopropyl)-9-methylthiadicarbocyanine sodium salt ($2.5\times10^{-4}$ mol per mol of silver halide)

As an anti-irradiation dye for each emulsion layer, the following dyes were used:

Green-Sensitive Emulsion Layer:

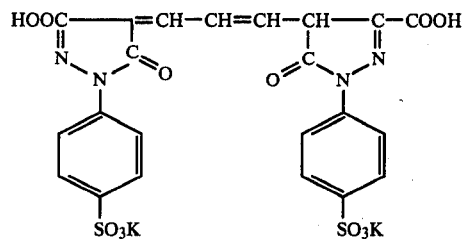

Red-Sensitive Emulsion Layer:

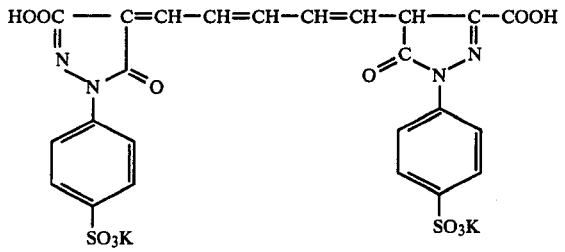

For the green-sensitive emulsion layer, the following anti-discoloration and fading-agents (A) and (B) were added to an oil with the magenta coupler dissolved therein in an amount of 40 mol% of the coupler. Anti-Discoloration and Fading-Agent (A):

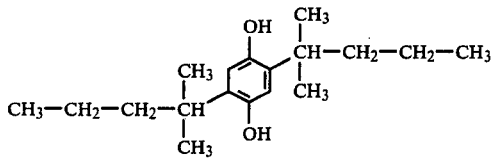

(A)

Anti-Discoloration and Fading-Agent (B):

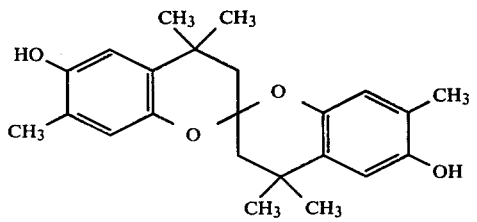

(B)

Sample 101 was produced in the same manner as for Sample 100 except that an ethylene-polyvinyl alcohol copolymer (produced by Kuraray Co., Ltd. under the trade name of Eval EP-F) containing titanium dioxide was used in place of the polyethylene-containing titanium dioxide (on which the silver halide emulsion layers were provided).

Sample 102 was produced in the same manner as for Sample 100 except that Eval EP-F was used in place of the polyethylene coated on the back surface of the paper support.

These samples were exposed to blue, green and red lights, respectively, so that the color density after development be 1.0, and then subjected to the following development processing.

On the other hand, Samples 100, 101 and 102 were subjected to the same development processing as above without being exposed to light.

| Processing Steps | Temperature (°C.) | Time |
|---|---|---|
| Development | 33 | 3 min 30 sec |
| Bleach-Fixation | 33 | 1 min 30 sec |
| Water-Washing | 28–35 | 3 min |

The formulation of each processing solution was as follows:

| Developer | |
|---|---|
| Benzyl Alcohol | 15 ml |
| Diethylene Glycol | 8 ml |
| Ethylenediaminetetraacetic Acid Disodium Salt | 5 g |
| Sodium Sulfite | 2 g |
| Anhydrous Potassium Carbonate | 30 g |
| Hydroxylamine Sulfuric Acid Salt | 3 g |
| Potassium Bromide | 0.6 g |
| 4-Amino-N-ethyl-N-(β-methanesulfonamidoethyl)-m-toluidine . ⅔ Sulfuric Acid Salt Monohydrate | 5 g |
| After adjustment of pH to 10.20 | |
| Water to make | 1 l |

| Bleach-Fixer | |
|---|---|
| Ethylenediaminetetraacetic Acid Disodium Salt | 2 g |
| Ethylenediaminetetraacetic Acid Iron (III) Salt | 40 g |
| Sodium Sulfite | 5 g |
| Ammonium Thiosulfate | 70 g |
| Water to make | 1 l |

Each sample so developed was irradiated with light for 15 days by use of a Xenon tester (illumination 200,000 lux), and the discoloration and fading was measured. For the measurement of the density, Macbeth Densitometer RD-514 was employed and blue, green and red lights were applied. Changes in density with an initial density as 1.0 and an increase in blue-light density of a white sample were measured. The results are shown in Table 2.

From the results shown in Table 2, it can be seen that Sample 101, produced according to the invention, shows marked improvement in its fading properties due to light of the magenta color image, and with respect to the stain produced by the light, in comparison with Comparative Samples 100 and 102. The yellow color image is apparently improved, but no increased fading by light of cyan color image is observed. Moreover, the results indicate that the extent of improvement in fading and staining properties due to light passing through the lamination of the oxygen-impermeable layer only onto the back side of the paper support is small, and is far less than Sample 101.

TABLE 1

| | |
|---|---|
| Sixth Layer (protective layer) | Gelatin (coating amount: 1,000 mg/m$^2$) |
| Fifth Layer (red-sensitive layer) | Silver chlorobromide emulsion (Br: 50 mol %; coating amount: Ag 300 mg/m$^2$), Gelatin (coating amount: 1,000 mg/m$^2$), Cyan coupler (*1) (coating amount: 400 mg/m$^2$), Coupler solvent (*2) (coating amount: 200 mg/m$^2$) |
| Fourth Layer (intermediate layer) | Gelatin (coating amount: 1,200 mg/m$^2$), Ultraviolet ray-absorbing agent (*3) (coating amount: 1,000 mg/m$^2$), Ultraviolet ray-absorbing agent solvent (*2) (coating amount: 250 mg/m$^2$) |
| Third Layer (green-sensitive layer) | Silver chlorobromide emulsion (Br: 50 mol %; coating amount: 290 mg/m$^2$), Gelatin (coating amount: 1,000 mg/m$^2$) Magenta coupler (*4) (coating amount: 200 mg/m$^2$), Coupler solvent (*5) (coating amount: 200 mg/m$^2$) |
| Second Layer (intermediate layer) | Gelatin (coating amount: 1,000 mg/m$^2$) |
| First Layer (blue-sensitive layer | Silver chlorobromide emulsion (Br: 80 mol %; coating amount: 400 mg/m$^2$), Gelatin (coating amount: 1,200 mg/m$^2$), Yellow coupler (*6) (coating amount: 300 mg/m$^2$), Coupler solvent (*7) (coating amount: 150 mg/m$^2$) |
| Support | Both-side polyethylene-laminated paper support |

(*1) Coupler: 2-[α-(2,4-di-tert-pentylphenoxy)butanamido]-4,6-dichloro-5-methylphenol
(*2) Solvent: Dibutylphthalate
(*3) Ultraviolet ray-absorbing agent: 2-(2-Hydroxy-3-sec-butyl-5-tert-butylphenyl)-benzotriazole
(*4) Coupler: 1-(2,4,6-Trichlorophenyl)-3-(2-chloro-5-tetradecanamido)anilino-2-pyrazoline-5-one
(*5) Solvent: Tricresyl phosphate
(*6) Coupler: α-Pivaloyl-α-(2,4-dioxo-5,5'-dimethyl-oxazolidine-3-yl)-2-chloro-5-[α-(2,4-di-tert-pentylphenoxy)butanamido]acetanilide
(*7) Solvent: Dioctylbutyl phosphate

TABLE 2

| Sample No. | Suppport: Surface-Laminated: Material | Suppport: Surface-Laminated: $O_2$ Permeability ($ml/m^2 \cdot hr \cdot atm$) | Suppport: Back Surface-Laminated Material | Yellow Density Change (initial density Db = 1.0) | Magenta Density Change (initial density Dg = 1.0) | Cyan Density Change (initial density Dr = 1.0) | Color Density Change of White Area (ΔDb) | Remarks |
|---|---|---|---|---|---|---|---|---|
| 100 | Polyethylene (PE) | 800 | PE | −0.40 | −0.65 | −0.34 | +0.25 | Comparative |
| 101 | Eval (EP-F) | 1 | PE | −0.25 | −0.30 | −0.32 | +0.08 | Invention |
| 102 | PE | 800 | Eval (EP-F) | −0.38 | −0.59 | −0.34 | +0.20 | Comparative |

EXAMPLE 2

In the same manner as for Sample 100 of Example 1 except that in place of the paper support a support was used which was prepared by coating an aqueous solution of polyvinyl alcohol (PVA) in an amount of 15 $g/m^2$ on the surface of the paper support by a rod coating method, a color light-sensitive material was produced (Sample 201).

In addition, in the same manner as for Sample 100 except that in place of the paper support a support was used which was prepared by coating PVA in an amount of 15 $g/m^2$ on the back of the paper support by the same method as used for Sample 201, a color light-sensitive material was produced (Sample 202).

The oxygen permeability of 15 $g/m^2$ of PVA coated on the paper was measured by the same method as previously described and found to be 0.1 $ml/m^2 \cdot hr \cdot atm$.

Each two of Samples 100, 201 and 202 were exposed and developed in the same manner as in Example 1. Each one of them was covered with a laminate film (oxygen permeability: 1 $ml/m^2 \cdot hr \cdot atm$ or less) prepared by coating an acrylic acid based adhesive on an 80μ PET film, by laminating the laminated film on both sides thereof by heat-sealing. For these samples, fading and stain tests were conducted, and the results are shown in Table 3.

These results clearly indicate that irrespective of increased fading due to light of the cyan in the samples covered with PET (80μ), Sample 201 of this invention was, as compared with Samples 100 and 202, greatly improved in resistance to fading due to light for the magenta and yellow dye images, without increasing the fading due to light of the cyan image. Therefore, little or no reduction in color balance occurs.

Samples 100, 201 and 202 developed as described above were subjected to a forced deterioration test for 5 days at 100° C. under dry conditions. For Samples 100 and 202, the coloration in white areas was great and the densities (Db) thereof measured with blue light increased from their initial densities by 0.30 and 0.29, respectively. On the other hand, for Sample 101 of this invention, the increment was 0.17. This indicates that for the color light-sensitive material of this invention, the formation of stain due to heat in white areas after processing is greatly controlled.

TABLE 3

| Sample No. | PET Film | Ratio of Residual Yellow (Db = 1.0) (%) | Ratio of Residual Magenta (Dg = 1.0) (%) | Ratio of Residual Cyan (Dr = 1.0) (%) |
|---|---|---|---|---|
| 100 | Not laminated | 60 | 35 | 66 |
| | Laminated | 71 | 68 | 51 |

TABLE 3-continued

| Sample No. | PET Film | Ratio of Residual Yellow (Db = 1.0) (%) | Ratio of Residual Magenta (Dg = 1.0) (%) | Ratio of Residual Cyan (Dr = 1.0) (%) |
|---|---|---|---|---|
| 201 | Not laminated | 73 | 65 | 64 |
| | Laminated | 76 | 70 | 48 |
| 202 | Not laminated | 63 | 39 | 65 |
| | Laminated | 73 | 67 | 52 |

EXAMPLE 3

Samples 100, 101 and 102 as produced in Example 1 were subjected to the following three development processings (A), (B) and (C) by the same method as in Example 1.

| | Processing Steps | Temperature (°C.) | Time |
|---|---|---|---|
| (A) | | | |
| | Development with Developer A | 33 | 3 min 30 sec |
| | Bleach-fixing | 33 | 1 min 30 sec |
| | Water washing | 28–35 | 3 min |
| (B) | | | |
| | The same as in (A) except that Developer B was used in place of Developer A. | | |
| (C) | | | |
| | Development with Developer A | 33 | 3 min 30 sec |
| | Bleach-fixing | 33 | 1 min 30 sec |
| | Water-washing | 28–35 | 2 min |
| | Stabilization | 33 | 1 min |

The formulation of each processing solution was as follows:

Developer A

The same developer as used in Example 1.

Developer B

A developer wherein benzyl alcohol and diethylene glycol were removed from Developer A.

Bleach-Fixer

The same as used in Example 1.

| Stabilizing Solution | |
|---|---|
| Tartaric Acid | 10 g |
| Zinc Sulfate | 10 g |
| Sodium Metaborate | 20 g |
| Water to make | 1 l |

The thus developed samples were subjected to the same prolonged test of stain as in Example 1. The results are shown in Table 4.

TABLE 4

| Sample No. | Stain by Light: Density Change (ΔDb) Processing (A) | Processing (B) | Processing (C) |
|---|---|---|---|
| 100 (comparison) | +0.25 | +0.20 | +0.15 |
| 101 (invention) | +0.08 | +0.08 | +0.07 |
| 102 (comparison) | +0.22 | +0.18 | +0.13 |

The above results clearly indicate that when Processing (A) is applied in which the color developer contains benzyl alcohol and no stabilizing bath is employed, staining due to light occurred to a great extent in Comparative Samples 100 and 102, whereas the formation of stain due to light was surprisingly well controlled in Sample 101 according to the invention. For Processing (B), wherein no benzyl alcohol was used, and Processing (C) wherein the stabilizing bath was used, the effect of this invention is also clearly apparent. However, in these Processings (B) and (C), the formation of stain due to light is relatively small even though the oxygen permeability of the resin layer on the emulsion layers is not controlled, and therefore the effect of improving stain according to this invention is relatively small in comparison with that in Processing (A).

EXAMPLE 4

Figure 2:
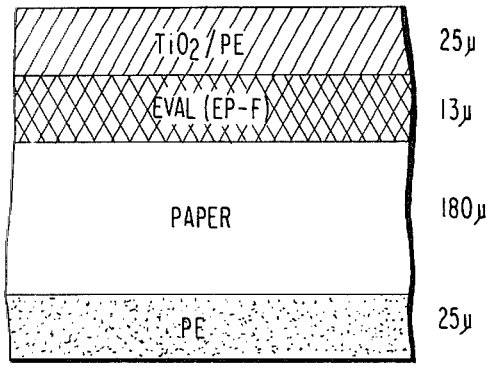
FIG. 2 is a sectional view of another embodiment of a paper support provided with an oxygen-impermeable layer according to the invention.

On a paper support laminated as illustrated in FIG. 1 were coated the emulsion layers in the same manner as in Example 1 to produce a color light-sensitive material (Sample 401). Next, a support laminated as illustrated in FIG. 2 was produced by melt-extrusion coating, on which the same emulsions as used in Sample 401 were successively coated to produce a color light-sensitive material (Sample 402).

Samples 100 (produced in Example 1), 401 and 402 were exposed and developed, and subjected to the test of fading by light and stain by light in the same manner as in Example 1, and furthermore subjected to a forced test for 2 weeks at 80° C. under dry conditions.

The results indicate that for Samples 401 and 402, the fading due to light of magenta and yellow and the coloration of white areas were markedly improved (under both forced conditions of light and heat). With regard to the fading due to light of the cyan image, all of the three samples were equal.

EXAMPLE 5

Samples 501 to 508 were produced in the same manner as in Sample 401 except that in the laminated support used in Sample 401 of Example 4 (illustrated in FIG. 1), those polymers as illustrated in Table 5 were used in place of polyvinyl alcohol.

Samples 501 to 508 were subjected, in the same manner as in Example 1, to exposure, development and tests for light fastness properties (irradiation with 100,000 lux Xenon light for 16 days). The results are shown in Table 5. The oxygen permeability was measured at 20° C. according to the method of ASTM-D-1434-63.

From the results of Table 5, it can be seen that the samples with a support provided with a polymer film having an oxygen permeability of 2.0 ml/m$^2$·hr·atm or less are markedly high in light fastness properties in comparison with those having an oxygen permeability of 2.0 ml/m$^2$·hr·atm or more.

TABLE 5

| Sample No. | Oxygen-Shielding Layer: Polymer | Thickness (μm) | Oxygen Permeability (ml/m$^2$ . hr . atm) | Light Fastness Properties (Xenon 100,000 lux, 16 days): Ratio of Residual Magenta Color Image (Dg = 1.0) (%) | Yellow Discoloration of White Areas (Δ Db) | Remarks |
|---|---|---|---|---|---|---|
| 501 | Polyethylene | 20 | 260 | 30 | 0.35 | Comparison |
| 502 | Cellulose Triacetate | 25 | 100 | 33 | 0.34 | " |
| 503 | Nylon 11 | 10 | 36 | 29 | 0.37 | " |
| 504 | Polyvinyl Alcohol | 25 | <0.1 | 80 | 0.09 | Invention |
| 505 | Polyvinyl Alcohol | 5 | 1 | 76 | 0.12 | " |
| 506 | Eval (EP-F) | 15 | <0.1 | 83 | 0.08 | " |
| 507 | Polyethylene Terephthalate | 85 | 1.5 | 78 | 0.13 | " |
| 508 | Polyethylene Terephthalate | 5 | 25 | 35 | 0.32 | Comparison |

EXAMPLE 6

Sample 600 was produced in the same manner as for Sample 100 of Example 1 except that in place of the emulsions used in the red-sensitive, green-sensitive and blue-sensitive layers, silver iodobromide emulsions containing respectively 4 mol%, 3 mol% and 3 mol% of iodine was used.

On the same support as produced for Sample 201 of Example 2 (after coating 15 g/m$^2$ of PVA on the side on which the emulsion layers were to be provided, both-side polyethylene coating was applied to obtain the support) were provided an emulsion layer, an intermediate layer and a protective layer in the same manner as for Sample 500 to produce Sample 601.

After application of exposure onto these samples in the same manner as in Example 1, they were develoepd as follows:

| Processing Steps | Temperature (°C.) | Time |
|---|---|---|
| First Development | 38 | 1 min 30 sec |
| Stopping | " | 45 sec |
| Water-washing | " | 3 min |
| Color Reversal Development | " | 2 min 45 sec |
| Water-Washing | " | 45 sec |

-continued

| Processing Steps | Temperature (°C.) | Time |
|---|---|---|
| Bleach-Fixing | " | 3 min |
| Water-Washing | " | 1 min 30 sec |

The formulation of each processing solution was as follows:

| | |
|---|---|
| First Developer | |
| Sodium Sulfite | 40 g |
| Sodium Carbonate | 16 g |
| Sodium Hydrogen Carbonate | 7 g |
| Sodium Thiocyanate | 1 g |
| Potassium Bromide | 1.5 g |
| Potassium Iodide | 6 mg |
| Hydroquinone | 7 g |
| Phenidone | 0.4 g |
| Water to make | 1 l |
| Stop Solution | |
| Glacial Acetic Acid | 20 g |
| Sodium Hydroxide | 1.5 g |
| Water to make | 1 l |
| Color Developer | |
| Benzyl Alcohol | 17 ml |
| Ethylene Glycol | 12 ml |
| 4-Amino-N-ethyl-N-(β-methane-sulfonamidoethyl)-m-toluidine . §Sulfuric Acid Monohydrate | 4.5 g |
| Sodium Sulfite | 2.5 g |
| Sodium Carbonate | 30 g |
| Sodium Hydroxide | 2.5 g |
| Hydroxyamine | 2.5 g |
| Water to make | 1 l |
| Bleach-Fixer | |
| Ethylenediaminetetraacetic Acid | 100 g |
| Iron (III) Ammonium Monohydrate | |
| Ethylenediaminetetraacetic Acid Disodium | 4 g |
| Aqueous Ammonia (28%) | 20 ml |
| Ammonium Thiosulfate | 200 g |
| Thiourea | 2 g |
| Water to make | 1 l |

Each sample so developed was subjected to the same discoloration and fading test as in Example 1. The results are shown in Table 6.

From the results shown in Table 6, it can be seen that Sample 601 of this invention was markedly improved in the fading and staining due to light of the magenta color image in comparison with Comparative Sample 600. Although the yellow color image was obviously improved, no increase in fading by light of the cyan color image was observed.

TABLE 6

| Sample No. | Ratio of Residual Dye (percents based upon initial density) Yellow | Magenta | Cyan | Color Density Change of White Areas (ΔDb) |
|---|---|---|---|---|
| 600 (comparison) | 66 | 32 | 65 | +35 |
| 601 (invention) | 73 | 78 | 66 | +0.12 |

While the invention has been described in detail and with reference to specific embodiments thereof, it will be apparent to one skilled in the art that various changes and modifications can be made therein without departing from the spirit and scope thereof.

What is claimed is:

1. A silver color photographic light-sensitive material comprising:

(a) a paper support;

(b) a color image-forming emulsion layer containing a photographic color coupler which forms a dye on coupling with an oxidized aromatic primary amine, said color image-forming emulsion layer comprising a blue-sensitive emulsion layer containing a yellow coupler, a green-sensitive emulsion layer containing a magneta coupler, a red-sensitive emulsion layer containing a cyan coupler, wherein said yellow coupler is selected from the group consisting of a coupler represented by the formula (IV)

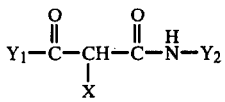

(IV)

wherein $Y_1$ represents an aliphatic group, an aromatic group or a heterocyclic group; $Y_2$ represents an aromatic group or a heterocyclic group; and X represents hydrogen or a cleavable group which is capable of being cleaved as an anion during the oxidation coupling reaction with the oxidation product of the aromatic primary amine developer, and a coupler represented by the formula (V)

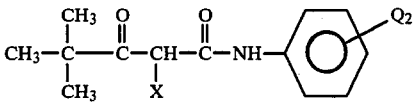

(V)

wherein $Q_1$ represents halogen, alkoxy, aryloxy, dialkylamino or alkyl; $Q_2$ is positioned at 4- or 5-position of the anilido nucleus and represents halogen, trifluoromethyl, acylamino, sulfonamido, ureido, alkyl, alkoxy, aryloxy, carboxy, alkoxycarbonyl, carbamoyl, sulfo, sulfamoyl or imido; and X represents hydrogen or a cleavable group which is capable of being cleaved as an anion during the oxidation coupling reaction with the oxidation product of the aromatic primary amine developer;

(c) an oxygen-impermeable layer having an oxygen permeability of not more than 2.0 $ml/m^{2''}\eta\theta\cdot atm$, said oxygen-impermeable layer being located between the paper support and the color image-forming layer; and (d) a protective layer providing a top surface on the same side of the paper support as the color image-forming layer and the oxygen-impermeable layer, said protective layer containing gelatin as a binder having a thickness of from about 0.4 to 4 μm.

2. A light-sensitive material as in claim 1 wherein the oxygen-impermeable layer comprises a homo- or copolymer of vinyl alcohol.

3. A light-sensitive material as in claim 2 wherein the oxygen-impermeable layer comprises a vinyl alcohol-ethylene copolymer.

4. A light-sensitive material as in claim 1 wherein the oxygen-impermeable layer has a thickness of from about 1 to 100μ.

5. A light-sensitive material as in claim 1 wherein the oxygen-impermeable layer has a thickness of from 2 to 50μ.

6. A light-sensitive material as in claim 1 wherein a polyolefin layer is provided on the opposite side of the paper support from the side bearing the oxygen-impermeable layer and the color image-forming layer.

7. A light-sensitive material as in claim 1 wherein a first polyolefin layer and the oxygen-impermeable layer are provided in sequence on the paper support on the same side thereof as that on which the color image-forming layer is provided.

8. A light-sensitive material as in claim 7 wherein a second polyolefin layer is provided on the opposite side of the oxygen-impermeable layer from said first polyolefin layer.

9. A light-sensitive material as in claim 1 wherein the oxygen-impermeable layer and a polyolefin layer are provided in sequence on the paper support on the same side thereof as that on which the color image-forming layer is provided.

10. A light-sensitive material as in claim 9 wherein another olefin layer is provided on the oxygen-impermeable layer.

11. A light-sensitive material as in claim 1 wherein said magneta coupler is a 3-anilino-5-pyrazolone type magenta coupler.

12. A light-sensitive material as in claim 11 wherein the magneta dye-forming color coupler is represented by the formula (III):

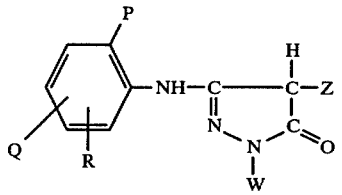

(III)

wherein P represents a straight, branched or cyclic alkyl, a substituted or unsubstituted aryl, an alkyloxy containing a straight, branched or cyclic alkyl, a substituted or unsubstituted aryloxy, an N-substituted amino, an amido, halogen, hydroxy, cyano, or nitro group; W represents hydrogen or a straight or branched alkyl, alkenyl, cyclic alkyl, aralkyl, cyclic alkenyl having from 1 to 35 carbon atoms, and preferably having from 1 to 22 carbon atoms, aryl and aryl having one or more substituents, a heterocyclic ring, acyl, thioacyl, alkylsulfonyl, arylsulfonyl, alkylsulfinyl, carbamoyl, or thiocarbamoyl; Q is a hydrophobic ballast group; R represents hydrogen or the same groups as defined for P or Q; and Z represents hydrogen or another group which is directly bonded at the coupling position, and which is cleaved during the coupling reaction with an oxidation product of a primary amine developing agent.

13. A light-sensitive material as in claim 1 wherein said yellow coupler is represented by the formula (IV):

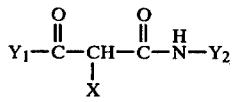

(IV)

wherein $Y_1$ represents an aliphatic group, an aromatic group or a heterocyclic group; $Y_2$ represents an aromatic group or a heterocyclic group; and X represents hydrogen or a cleavable group which is capable of being cleaved as an anion during the oxidation coupling reaction with the oxidation product of the aromatic primary amine developer.

14. A light-sensitive material as in claim 1 wherein said yellow coupler is represented by the formula (V):

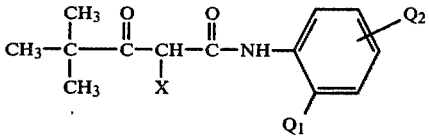

(V)

wherein $Q_1$ represents halogen, alkoxy, aryloxy, dialkylamino or alkyl; $Q_2$ is positioned at 4- or 5-position of the anilido nucleus and represents halogen, trifluoromethyl, acylamino, sulfonamido, ureido, alkyl, alkoxy, aryloxy, carboxy, alkoxycarbonyl, carbamoyl, sulfo, sulfamoyl or imido; and X represents hydrogen or a cleavable group which is capable of being cleaved as an anion during the oxidation coupling reaction with the oxidation product of the aromatic primary amine developer.

15. A light-sensitive material as in claim 1 wherein the material is subjected to the so-called two-bath processing using a color developer and a bleach-fixer.

16. A light-sensitive material as in claim 15 wherein the developer contains benzyl alcohol.

17. A light-sensitive material as in claim 16 wherein the amount of benzyl alcohol being added is 1 to 30 ml per liter of the color developer.

18. A light-sensitive material as in claim 1 comprising, in sequence: a paper support, an oxygen-impermeable layer, a blue-sensitive emulsion layer containing a yellow coupler, an intermediate layer on the blue-sensitive emulsion layer, a green-sensitive emulsion layer containing a magenta coupler, an intermediate layer on the green-sensitive emulsion layer, a red-sensitive emulsion layer containing a cyan coupler, and a protective layer on the red-sensitive emulsion layer.

19. A light-sensitive material as in claim 1 comprising, in sequence: a paper support, a green-sensitive emulsion layer containing a magneta coupler, an intermediate layer on the blue-sensitive emulsion layer, a blue-sensitive emulsion layer containing a yellow coupler, an intermediate layer on the green-sensitive emulsion layer, a red-sensitive emulsion layer containing a cyan coupler, and a protective layer on the red-sensitive emulsion layer.

20. A light-sensitive material as in claim 1 wherein a 3-anilino-5-pyrazolone type coupler is used as the magneta coupler, a pivaloyl type coupler is used as the yellow coupler, and a phenol type coupler is used as a cyan coupler.

* * * * *